US008403455B2

(12) United States Patent
Hayashi

(10) Patent No.: US 8,403,455 B2
(45) Date of Patent: Mar. 26, 2013

(54) FLUID EJECTING APPARATUS

(75) Inventor: Takato Hayashi, Minowa-machi (JP)

(73) Assignee: Seiko Epson Corporation, Tokyo (JP)

( * ) Notice: Subject to any disclaimer, the term of this patent is extended or adjusted under 35 U.S.C. 154(b) by 134 days.

(21) Appl. No.: 13/024,511

(22) Filed: Feb. 10, 2011

(65) Prior Publication Data

US 2011/0199429 A1 Aug. 18, 2011

(30) Foreign Application Priority Data

Feb. 12, 2010 (JP) ..... 2010-028880

(51) Int. Cl.
*B41J 2/165* (2006.01)

(52) U.S. Cl. ..... 347/31; 347/32

(58) Field of Classification Search ..... 347/22, 347/30–32

See application file for complete search history.

(56) References Cited

U.S. PATENT DOCUMENTS 7,562,961 B2 7/2009 Inoue
2010/0118084 A1 5/2010 Seshimo

FOREIGN PATENT DOCUMENTS

JP 2005-119284 5/2005

*Primary Examiner* — Lamson Nguyen
(74) *Attorney, Agent, or Firm* — Workman Nydegger

(57) ABSTRACT

A fluid ejecting apparatus includes a fluid ejecting head having nozzle rows formed by a plurality of nozzles, in which a fluid is ejected from the nozzle rows. The fluid ejecting apparatus includes an absorbing member which extends along the nozzle rows in a movable manner, a moving mechanism which moves the absorbing member in a direction intersecting the nozzle rows, and a running mechanism which runs the absorbing member. The moving mechanism includes a moving member movably provided, a positioning member movably provided on the moving member and having the absorbing member in a movable manner, and a first biasing member for biasing the positioning member in a predetermined direction. A tension applying mechanism apply a tension to the absorbing member is provided.

6 Claims, 10 Drawing Sheets

FLUID EJECTING APPARATUS

The entire disclosure of Japanese Patent Application No. 2010-28880, filed Feb. 12, 2010 is expressly incorporated by reference herein.

BACKGROUND

1. Technical Field

The present invention relates to a fluid ejecting apparatus.

2. Related Art

In the related art, an ink jet printer (hereinafter refer to as a "printer") is widely known as a fluid ejecting apparatus capable of ejecting ink droplets onto a printing sheet (medium). Such a printer has a problem that nozzles are clogged by increased viscosity or solidification of ink which results from evaporation of the ink from the nozzles of a printing head, attached dust, commingling of bubbles, or the like, thereby resulting in printing failure. Accordingly, such a printer is configured to carry out a flushing operation to forcibly discharge the ink from the inside of the nozzles, aside from the ejection with respect to the printing sheets.

In general, although a printing head is moved to an area other than a printing area to carry out the flushing operation in a scan type printer, a printer equipped with a line head with a fixed printing head is not able to move the printing head at the time of the flushing operation. Accordingly, for example, a method of ejecting the ink onto an absorbing material (absorbing member), which is provided on a surface of a transporting belt for transporting the printing sheet, has been considered (refer to JP-A-2005-119284).

However, in the technology disclosed in JP-A-2005-119284, since a plurality of absorbing materials are placed at regular intervals on the transporting belt to coincide with the size of the printing sheet, the ink must be ejected while aiming for a gap between the printing sheets when flushing. Therefore, there is a problem that the size of the printing sheets or the transporting speed of the printing sheet is limited. In addition, if the flushing is carried out with respect to the planar absorbing material, the ink of a mist form is scattered by wind pressure which is generated with the discharge of the ink droplets, so that the surface of the printing sheet or the transporting belt may be contaminated.

Accordingly, there is considered a method of receiving the ink into an absorbing member, in which a linear absorbing material is used, and the linear absorbing member (absorbing material) is interposed between the line head and the printing sheet (printing medium), so that the flushing is carried out by ejecting the ink to the absorbing member. In this instance, the absorbing member should be necessarily moved between a flushing position, in which the absorbing member absorbs the ink droplets ejected from the nozzles, and a retraction position, in which the absorbing member is retracted from the flight path of the ink droplets ejected from the nozzles, during the intermission of the flushing operation and the printing of the printing sheet.

However, for example, when the absorbing member is moved from the retraction position to the flushing position, vibration is generated in the absorbing member due to the acceleration or the deceleration resulting from movements and stoppages. If the flushing is carried out under the vibrating state, the ink droplets do not get trapped by the absorbing member, and thus the printing sheet or a surface for holding the printing sheet may be contaminated. It is necessary to stand by without carrying out the flushing operation until the vibration of the absorbing member is stabilized. However, for example, if the flushing is periodically carried out in the interval of the printing, it is important to shorten the printing time and to shorten the flushing time. Therefore, it is necessary to further shorten the time needed for the flushing.

In order to suppress the vibration of the absorbing member, the influence of the acceleration or the deceleration which results from the movements and stoppages of the absorbing member should be reduced. To this end, it is considered that a motor having an advanced mechanism is employed, and that the driving of the motor is highly controlled. However, there is an adverseness that such a motor is expensive, and thus if the motor is employed, the cost of the printer is significantly increased.

SUMMARY

An advantage of some aspects of the invention is to provide a fluid ejecting apparatus including a linear absorbing member for receiving a fluid, in which in a case where the absorbing member is moved, for example, vibration of the absorbing member, which is generated when the absorbing member is moved between a retraction position and a flushing position, is suppressed by a simple mechanical mechanism without using an expensive motor.

According to an aspect of the invention, there is provided a fluid ejecting apparatus including a fluid ejecting head having nozzle rows formed by a plurality of nozzles, in which a fluid is ejected from the nozzle rows, the fluid ejecting apparatus including: a linear absorbing member which extends along the nozzle row, is installed so as to move from one side of the nozzle row to the other side, and absorbs the fluid ejected from the nozzles; a moving mechanism which moves the absorbing member in a direction intersecting the nozzle row; and a running mechanism which runs the absorbing member from the one side of the nozzle row to the other side; the moving mechanism including a pair of moving mechanism sections which are respectively placed at one side and the other side of the nozzle row to move the absorbing member from a reference position of one side to a predetermined position of the other side in a direction perpendicular to the nozzle row, and to move the absorbing member from the predetermined position to the reference position; the moving mechanism section having a moving member provided so as to reciprocate along the direction intersecting the nozzle row, a positioning member provided on the moving member so as to move along the direction intersecting the nozzle row, having a stop position at the predetermined position in the direction perpendicular to the nozzle row, and having the absorbing member in a movable manner, and the first biasing member for biasing the positioning member from the reference position side to the predetermined position side in the direction perpendicular to the nozzle row; the pair of moving mechanism sections holding the absorbing member between the respective positioning members, and being adapted to extend the absorbing member along the nozzle row; the positioning member being adapted to be biased in a direction opposite to the biasing direction of the first biasing member if the tension of the held absorbing member becomes strong; and a tension applying mechanism applying tension to the absorbing member held between the positioning members, and decreasing the tension applied to the absorbing member if the positioning member moves to the reference position side in the direction perpendicular to the nozzle row or increasing the tension applied to the absorbing member if the positioning member moves to the predetermined position side.

According to an aspect of the fluid ejecting mechanism, if the moving member is moved to cause the absorbing member to move, for example, from the reference position which is a retraction position to a flushing position which is the predetermined position, the tension applied to the absorbing member can be increased by the tension applying mechanism. Then, if the tension of the held absorbing member is increased, the positioning member is biased toward a direction opposite to the biasing direction of the first biasing member. Accordingly, if the tension of the absorbing member is higher than the biasing force of the first biasing member, the positioning member is moved in the direction opposite to the biasing direction of the first biasing member, that is, the reference position side, with respect to the moving member.

Therefore, in an initial stage of the movement, since the tension applied to the absorbing member is increased by the tension applying mechanism, the absorbing member is moved slightly toward the side (reference position side) opposite to the moving direction (predetermined position side) of the moving member, thereby suppressing the acceleration of the absorbing member when the moving member is moved.

In addition, if the positioning member moves toward the reference position side which is the direction opposite to the biasing direction of the first biasing member, the tension applied to the absorbing member is decreased by the tension applying mechanism. For example, the tension is further decreased by extending the length of the absorbing member. If the tension is lower than the biasing force of the first biasing member, the positioning member is moved toward the predetermined position side which is the biasing direction of the first biasing member, so that the positioning member reaches a stop position and then stops thereat.

Accordingly, in a final stage of movement, since the tension applied to the absorbing member is decreased by the tension applying mechanism, the absorbing member is moved slightly toward the moving direction (predetermined position side) of the moving member and stops, thereby suppressing the deceleration of the absorbing member when the moving member is stopped.

Therefore, the absorbing member can suppress the acceleration at the initial stage of the movement or the deceleration at the final stage of the movement, so that the influence of the acceleration or deceleration resulted from the movement of the absorbing member is decreased to minimally suppress the vibration of the absorbing member which can be caused by the influence at the time of the movement.

Further, the suppression of the vibration can be achieved by a simple mechanical mechanism without using an expensive motor.

In the fluid ejecting apparatus, it is preferable that the running mechanism includes a delivery rotation body which delivers the absorbing member by unwinding the absorbing member from a state where the absorbing member is wound, a delivery driving portion for rotating the delivery rotation body, a winding rotation body which winds the absorbing member delivered from the delivery rotation body, and a winding driving portion for rotating the winding rotation body.

With the above configuration, as described above, since the positioning member is moved toward the reference position side which is the direction opposite to the biasing direction of the first biasing member, when the tension applied to the absorbing member is decreased by the tension applying mechanism, the delivery driving portion is controlled to rotate the delivery rotation body, so that the length of the absorbing member is extended to further decrease the tension.

In addition, in the fluid ejecting apparatus, it is preferable that the tension applying mechanism includes a tension adjusting member which applies a predetermined tension to the absorbing member held between the positioning members, and is displaced in accordance with the tension of the absorbing member to change an intensity of the tension applied to the absorbing member.

With the above configuration, since the tension adjusting member changes the intensity of the tension applied to the absorbing member, it is possible to further suppress the acceleration at the initial stage of the movement or the deceleration at the final stage of the movement in the absorbing member, so that the influence of the acceleration or deceleration resulted from the movement of the absorbing member is reduced.

Further, in the fluid ejecting apparatus, it is preferable that the tension adjusting member is provided in such a way that a holding position, in which the absorbing member is held, is displaceable in the direction intersecting the nozzle row, and that the holding position is biased in the direction opposite to the biasing direction of the first biasing member by a second biasing member.

With the above configuration, the change in the intensity of the tension applied to the absorbing member by the tension adjusting member can be easily adjusted by the second biasing member.

In addition, in the fluid ejecting apparatus, it is preferable that the running mechanism includes a delivery rotation body which delivers the absorbing member by unwinding the absorbing member from a state where the absorbing member is wound, a delivery driving portion for rotating the delivery rotation body, a winding rotation body which winds the absorbing member delivered from the delivery rotation body, and a winding driving portion for rotating the winding rotation body, wherein the tension adjusting member is provided at the delivery rotation body side from the nozzle row, wherein an inspection rotation body that makes the absorbing member to revolve and rotate according to the running of the absorbing member is provided in a running path of the absorbing member which runs between the delivery rotation body and the tension adjusting member, and wherein the inspection rotation body is provided with a detection mechanism for detecting a running length of the absorbing member which rotates the inspection rotation body by detecting the revolution of the inspection rotation body.

In this way, since a revolution of the inspection rotation body is directly proportional to the running length (running distance) of the absorbing member, the detection mechanism can precisely detect the running length of the absorbing member. Accordingly, when the moving member is moved to cause the absorbing member to move, for example, from the reference position which is a retraction position to the flushing position which is the predetermined position, an amount corresponding to the changed length of the absorbing member according to the movement can be supplemented by rotating the delivery rotation body. Since a delivery amount of the absorbing member from the delivery rotation body is precisely figured out at that time, the amount corresponding to the changed length of the absorbing member according to the movement can be accurately and appropriately supplemented. Therefore, it is possible to maintain the tension of the absorbing member equally at the retraction position and the flushing position.

Further, in the fluid ejecting apparatus, it is preferable that the inspection rotation body is provided with an identifier along a circumferential direction, and that the detection mechanism detects the identifier to detect the revolution of the inspection rotation body.

In this way, it is possible to detect the revolution of the inspection rotation body with the simple configuration.

BRIEF DESCRIPTION OF THE DRAWINGS

The invention will be described with reference to the accompanying drawings, wherein like numbers reference like elements.

DESCRIPTION OF EXEMPLARY EMBODIMENTS

A fluid ejecting apparatus according to a first embodiment of the invention will now be described with reference to the accompanying drawings. In this instance, in the various drawings used in the following description, the scales of the various constituents are appropriately modified in order to allow the respective constituents to have various sizes.

In this embodiment, an ink jet printer (hereinafter, simply referred to as a printer) is exemplified as the fluid ejecting apparatus.

Figure 1:
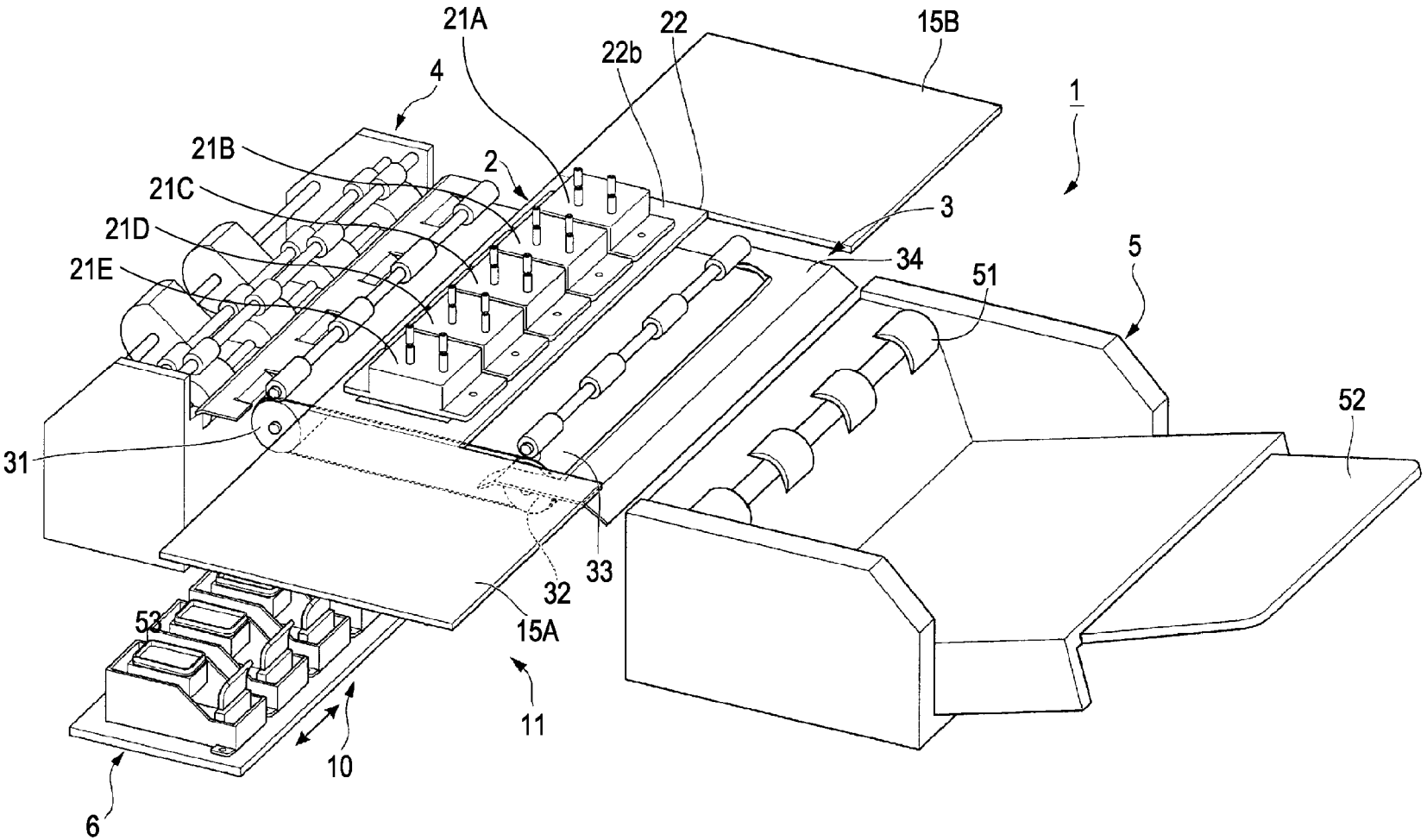
FIG. 1 is a perspective view schematically illustrating the configuration of a printer according to a first embodiment.
Figure 2:
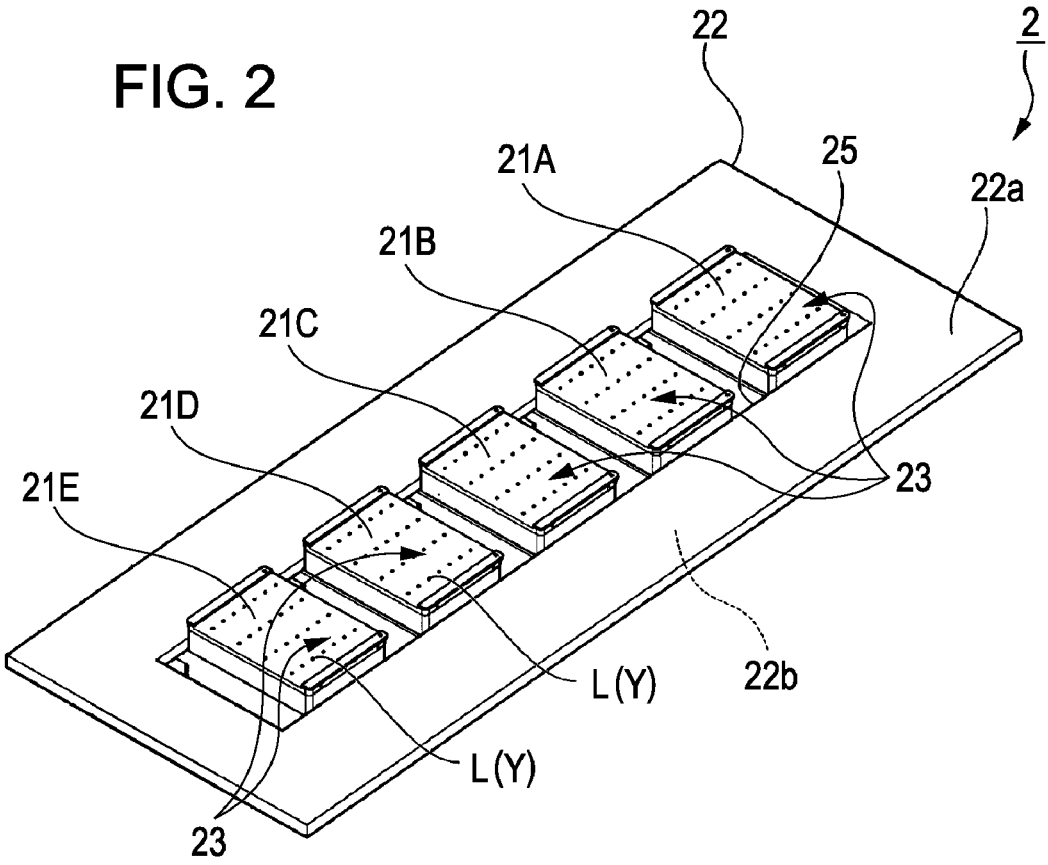
FIG. 2 is a perspective view schematically illustrating the configuration of a head unit according to a first embodiment.
Figure 3:
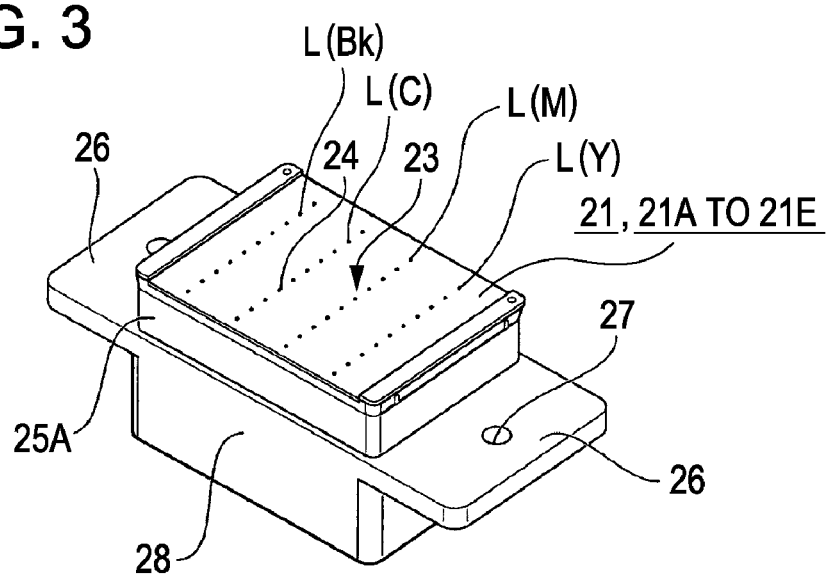
FIG. 3 is a perspective view schematically illustrating the configuration of a printing head according to a first embodiment.
Figure 4:
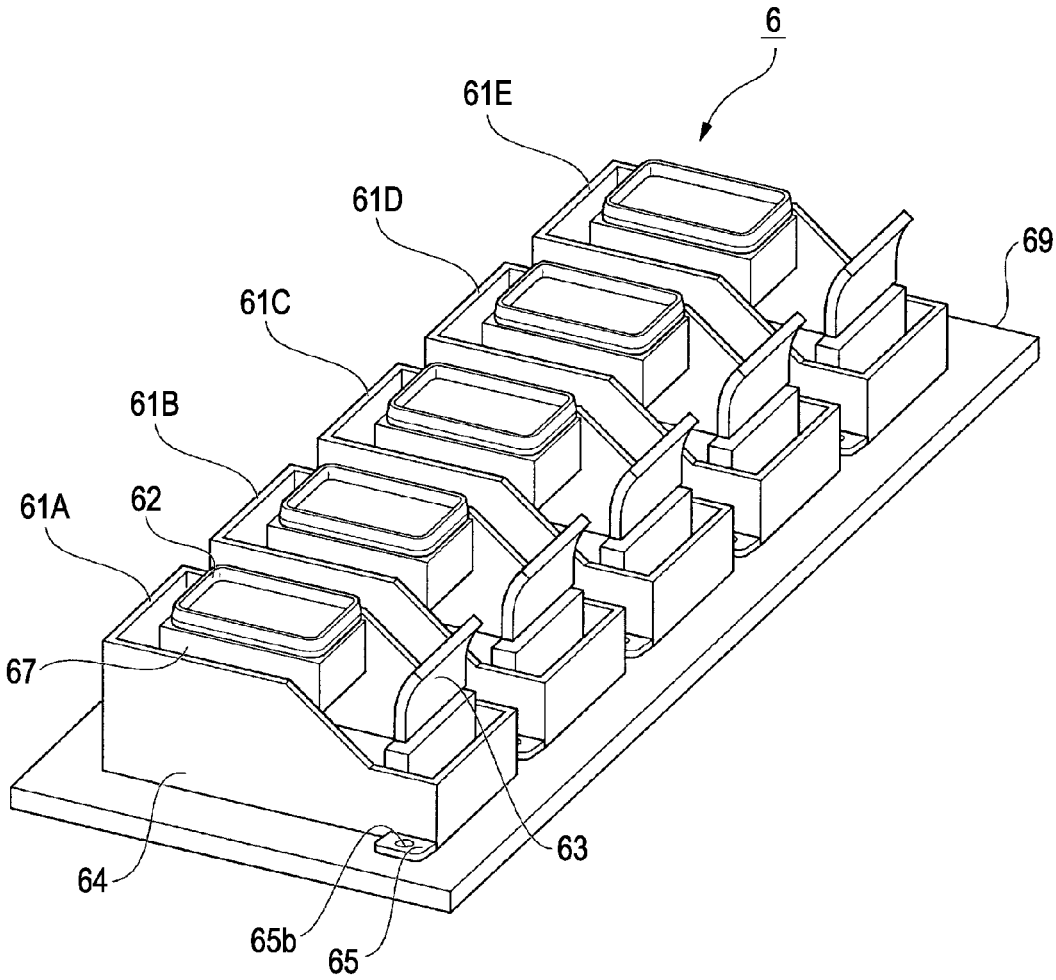
FIG. 4 is a perspective view schematically illustrating the configuration of a cap unit according to a first embodiment.

FIG. 1 is a perspective view schematically illustrating the configuration of the printer. FIG. 2 is a perspective view schematically illustrating the configuration of a head unit. FIG. 3 is a perspective view schematically illustrating the configuration of a printing head (fluid ejecting head) constituting the head unit. FIG. 4 is a perspective view schematically illustrating the configuration of a cap unit.

As shown in FIG. 1, a printer 1 includes a head unit 2, a transporting device 3 which transports a printing sheet (printing medium), a sheet feeding unit 4 which supplies the printing sheet, a sheet discharging unit 5 which discharges the printing sheet subjected to a printing operation of the head unit 2, and a maintenance device 10 which performs a maintenance operation on the head unit 2.

The transporting device 3 is adapted to hold the printing sheet while maintaining a predetermined gap between the printing sheet and nozzle surfaces 23 of printing heads (fluid ejecting head) 21 (21A, 21B, 21C, 21D, and 21E) constituting the head unit 2. The transporting device 3 includes a driving roller portion 31, a driven roller portion 32, and a transporting belt portion 33 which has a plurality of belts suspended between the roller portions 31 and 32. In addition, a holding member 34 is provided between the sheet discharging units 5 which is the downstream side of the transporting device 3 (on the side of the sheet discharging unit 5) in the transporting direction of the printing sheet so as to hold the printing sheet.

One end of the driving roller portion 31 in the rotation axis direction is connected to a driving motor (not illustrated), and is rotationally driven by the driving motor. The rotation force of the driving roller portion 31 is transmitted to the transporting belt portion 33, so that the transporting belt portion 33 is rotationally driven. If necessary, a transmission gear is provided between the driving roller portion 31 and the driving motor. The driven roller portion 32 is a so-called free roller which supports the transporting belt portion 33 and is rotated by the rotational driving operation of the transporting belt portion 33 (the driving roller portion 31).

The sheet discharging unit 5 includes a sheet discharging roller 51 and a sheet discharging tray 52 which holds the printing sheet transported by the sheet discharging roller 51.

The head unit 2 is formed as a unit including a plurality (in this embodiment, five) of printing heads 21A to 21E, and a plurality of colors of ink (for example, ink having colors of black B, magenta M, yellow Y, and cyan C) adapted to be ejected from nozzles 24 (refer to FIG. 3) of the printing heads 21A to 21E. The printing heads 21A to 21E (hereinafter, referred to as the printing heads 21 in some cases) are formed as a unit which is attached to an attachment plate 22. That is, the head unit 2 according to this embodiment constitutes a line head module which has a plurality of combinations of printing heads 21 and in which an effective printing width of the head unit 2 is substantially equal to the transverse width (the width perpendicular to the transporting direction of the printing sheet) of the printing sheet. In addition, the printing heads 21A to 21E have the same structure.

As shown in FIG. 2, the head unit 2 has a configuration in which the printing heads 21A to 21E are arranged inside an opening 25 formed in an attachment plate 22. More specifically, the printing heads 21A to 21E are screw-fixed to a rear surface 22*b* side of the attachment plate 22 so that the nozzle surfaces 23 project from a front surface 22*a* of the attachment plate 22 through the opening 25. In addition, the head unit 2 is mounted onto the printer 1 by fixing the attachment plate 22 to a carriage (not illustrated).

The head unit 2 according to this embodiment is adapted to be movable between a printing position and a maintenance position (in a direction depicted by the arrow in FIG. 1) by the carriage. Here, the printing position is a position which faces the transporting device 3 and in which a printing operation is performed on the printing sheet. Meanwhile, the maintenance position is a position in which the head unit 2 is retracted from the transporting device 3 and which faces a maintenance device 10. In the maintenance position, a maintenance process (a suction process and a wiping operation) is performed on the head unit 2.

As shown in FIG. 3, each of the printing heads 21A to 21E (hereinafter, simply referred to as the printing head 21 in some cases) constituting the head unit 2 includes a head body 25A which has the nozzle surface 23 having nozzle rows L formed by a plurality of nozzles 24 and a support member 28 onto which the head body 25A is mounted.

Each of the printing heads 21A to 21E has four nozzle rows (L(Y), L(M), L(C), and L(Bk)) corresponding to four colors (yellow (Y), magenta (M), cyan (C), and black (Bk)). Thus four nozzle rows are formed. In the nozzle rows (L(Y), L(M), L(C), and L(Bk)), the nozzles 24 constituting the nozzle rows (L(Y), L(M), L(C), and L(Bk)) are arranged in the horizontal direction perpendicular to the transporting direction of the printing sheet, and more specifically, are arranged in the horizontal direction perpendicular to the transporting direction of the printing sheet. In addition, in the direction where the printing heads 21A to 21E are arranged, the respective nozzle rows are arranged so that the nozzle rows L having the same color are aligned in a line in the printing heads 21A to 21E. Meanwhile, in the respective printing heads 21A to 21E, two nozzle rows L may be formed for each color of (Y), (M), (C), and (Bk) to form eight nozzle rows L in total. In this instance, it is preferable that two rows of the nozzle rows provided for each color are placed in a staggered pattern.

Projecting portions 26 and 26 are formed on both sides of the support member 28 in the longitudinal direction of the nozzle surface 23. In addition, each of the projecting portions 26 and 26 is provided with a penetration hole 27 which is used to screw-fix the printing head 21 to the rear surface 22*b* of the attachment plate 22. Accordingly, the head unit 2 is obtained in which the plurality of printing heads 21 is attached to the attachment plate 22 (see FIG. 1).

The maintenance device 10 includes a cap unit 6 which receives the ink ejected by the flushing operation on the head unit 2 and a flushing unit 11 which performs the suction operation.

As shown in FIG. 4, the cap unit 6 is a unit which performs the maintenance operation on the head unit 2 and includes a plurality (in this embodiment, five) of cap portions 61A to 61E respectively corresponding to the printing heads 21A to 21E. The cap unit 6 is disposed at a position deviated from the printing area of the head unit 2.

The cap portions 61A to 61E (hereinafter, simply referred to as a cap portion 61 in some cases) respectively correspond to the printing heads 21A to 21E, and are adapted to respectively come into contact with the nozzle surfaces 23 of the printing heads 21A to 21E. Since the cap portions 61A to 61E respectively come into close contact with the nozzle surfaces 23 of the printing heads 21A to 21E with the above configuration, it is possible to satisfactorily perform the suction operation in which ink (fluid) is discharged from each of the nozzles 24 of the nozzle surfaces 23.

In addition, each of the cap portions 61A to 61E includes a cap body 67, a seal member 62 which is formed on the upper surface of the cap body 67 so as to have a frame shape and come into contact with the printing head 21, a wiper member 63 which is used in the wiping operation of wiping the nozzle surface 23 of the printing head 21, and a casing portion 64 which integrally retains the cap body 67 and the wiper member 63.

The bottom portion of the casing portion 64 is provided with two holding portions 65 (here, one of them is not shown in the drawing) which are used to hold the casing portion 64 in a base member 69. The holding portions 65 are disposed in the casing portion 64 so as to have a diagonal relationship therebetween at a plan view. Each of the holding portions 65 is provided with a penetration hole 65*b* into which a screw is inserted so as to screw-fix the casing portion 64 to the base member 69.

Figure 5A:
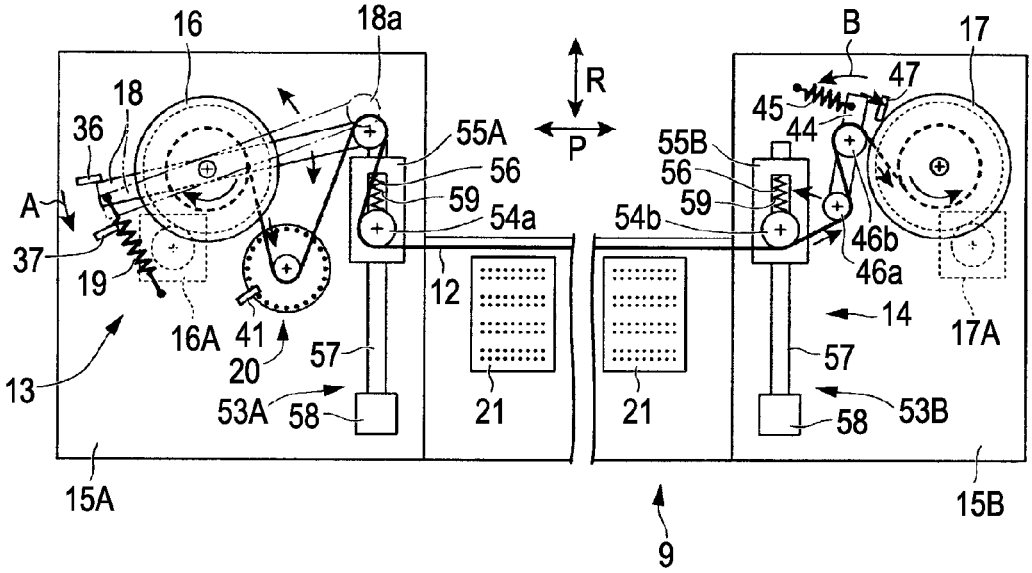
FIGS. 5A and 5B are bottom views schematically illustrating the configuration of a flushing unit.
Figure 5B:
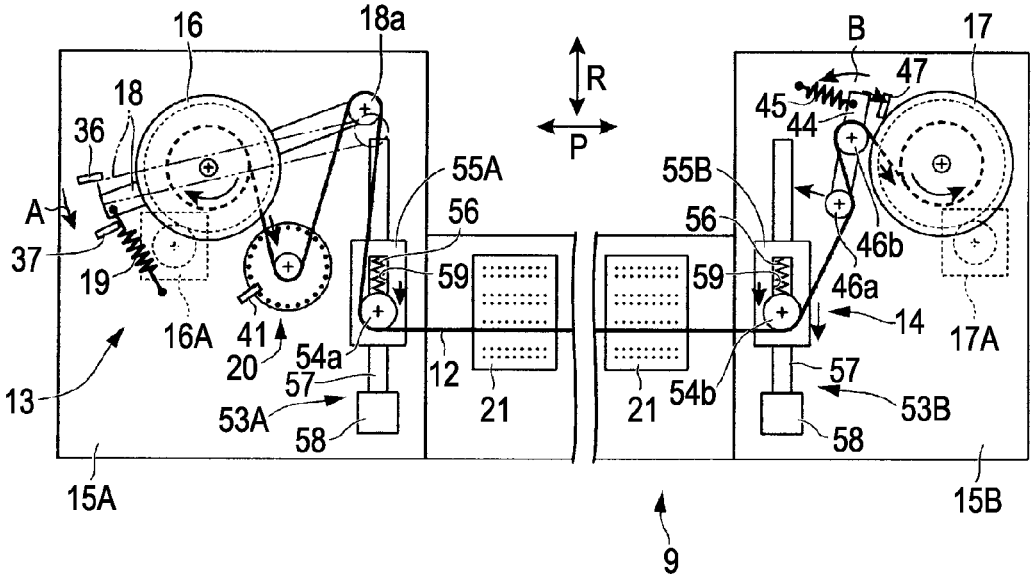

As shown in FIGS. 5A and 5B illustrating a bottom side of the head unit 2, the flushing unit 11 includes an absorbing member 12 which absorbs ink droplets (fluid) ejected during the flushing operation, and a support mechanism 9 which supports the absorbing member 12.

The absorbing member 12 is formed as a linear member which absorbs the ink droplets ejected from each nozzle 24. In this embodiment, one absorbing member is provided for one head unit 2. The absorbing member 12 is disposed so as to extend along the corresponding nozzle rows (L(Y), L(M), L(C), and L(Bk)), and is located between the nozzle surfaces 23 and a sheet transporting region of the printing sheet, since the absorbing member is movably held by the moving mechanism 14 which will be described below.

In addition, the absorbing members 12 are formed of, for example, a yarn material or the like. It is preferable to use a material capable of effectively absorbing and holding (containing) the ink. Specifically, the absorbing member 12 may be formed of, for example, fiber such as SUS 304, nylon, nylon applied with a hydrophobic coating, aramid, silk, cotton, polyester, ultrahigh molecular weight polyethylene, polyarylate, or Zylon (product name), or a compound fiber containing a plurality thereof.

More specifically, it is possible to form the absorbing member 12 in such a manner that a plurality of fiber bundles formed by the fiber or the compound fiber are twisted or bound.

Figure 6A:
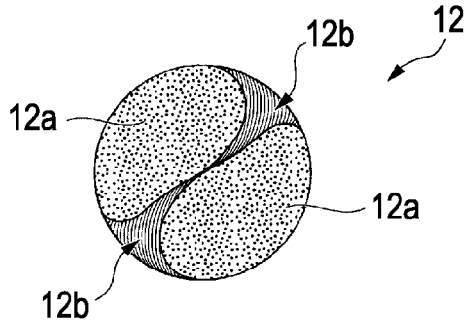
FIGS. 6A and 6B are enlarged views schematically illustrating an absorbing member.
Figure 6B:
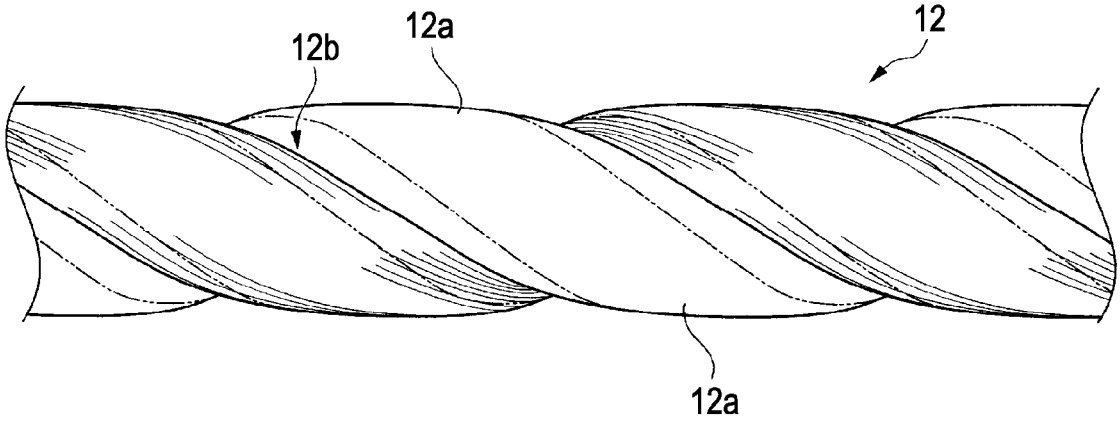

FIGS. 6A and 6B are schematic diagrams showing an example of the absorbing member 12, where FIG. 6A is a cross-sectional view and FIG. 6B is a plan view. As shown in FIGS. 6A and 6B, for example, the absorbing member 12 is formed in such a manner that two fiber bundles 12*a* formed by the fiber are twisted.

In addition, as an example, a linear member obtained by binding fiber bundles formed by SUS 304, a linear member obtained by binding fiber bundles formed by nylon, a linear member obtained by binding fiber bundles formed by nylon applied with hydrophobic coating, a linear member obtained by binding fiber bundles formed by aramid, a linear member obtained by binding fiber bundles formed by silk, a linear member obtained by binding fiber bundles formed by cotton, a linear member obtained by binding fiber bundles formed by Belima (product name), a linear member obtained by binding fiber bundles formed by Soierion (product name), a linear member obtained by binding fiber bundles formed by Hamilon 03T (product name), a linear member obtained by binding fiber bundles formed by Dyneema hamilon DB-8 (product name), a linear member obtained by binding fiber bundles formed by Vectran hamilon VB-30, a linear member obtained by binding fiber bundles formed by Hamilon S-5 Core Kevlar Sleeve Polyester (product name), a linear member obtained by binding fiber bundles formed by Hamilon S-212 Core Coupler Sleeve Polyester (product name), a linear member obtained by binding fiber bundles formed by Hamilon SZ-10 Core Zylon Sleeve Polyester (product name), or a linear member obtained by binding fiber bundles formed by Hamilon VB-3 Vectran (product name) may be appropriately used as the absorbing member 12.

Since the absorbing member 12 obtained by the fiber of nylon is formed by nylon widely used as a general leveling yarn, the absorbing member 12 is cheap.

Since the absorbing member 12 obtained by the metallic fiber of SUS has an excellent corrosion resistance property, it is possible to allow the absorbing member 12 to absorb a variety of ink. Also, since the absorbing member 12 has an excellent wear resistance property compared with a resin, it is possible to repeatedly use the absorbing member 12.

The absorbing member 12 obtained by the fiber of ultrahigh molecular weight polyethylene has high cutting strength and chemical resistance, and is strong against organic solvents, acids, or alkali. Likewise, since the absorbing member 12 obtained by the fiber of ultrahigh molecular weight polyethylene has high breaking strength, it is possible to pull the absorbing member 12 in a high-tension state, and to prevent the absorbing member 12 from bending. For this reason, in the case where the diameter of the absorbing member 12 is thickened so as to increase the absorbing capacity or the diameter of the absorbing member 12 is not thickened, it is possible to improve the printing precision by narrowing the distance between the printing sheet transporting region and the heads 21A to 21E. In addition, it is expected that the above-described advantage is obtained even in the absorbing member 12 obtained by the fiber of Zylon or aramid and the absorbing member 12 obtained by the fiber of ultrahigh molecular polyethylene.

The absorbing member 12 obtained by the fiber of cotton has an excellent ink absorbing property.

In the absorbing member 12, the dropped ink is retained in a valley portion 12*b* (refer to FIG. 6) formed between the fiber bundle 12*a* and the fiber due to the surface tension, so that the ink is absorbed and contained.

In addition, a part of the ink dropped onto the surface of the absorbing member 12 directly enters into the absorbing member 12, and the rest moves to the valley portion 12*b* formed between the fiber bundles 12*a*. Further, a part of the ink entering into the absorbing member 12 gradually moves in the extension direction of the absorbing member 12 in the inside of the absorbing member 12 so as to be held therein while being dispersed in the extension direction of the absorbing member 12. A part of the ink moving to the valley portion 12*b* of the absorbing member 12 gradually enters into the absorbing member 12 through the valley portion 12*b*, and the rest remains in the valley portion 12*b* so as to be held therein while being dispersed in the extension direction of the absorbing member 12. That is, all the ink dropped onto the surface of the absorbing member 12 does not stay at the dropped position in the long-term, but is dispersed and absorbed in the vicinity of the dropped position.

In fact, a material forming the absorbing member 12 provided in the printer 1 is selected appropriately in consideration of ink absorbing property, ink holding property, tensile strength, ink resistance property, formability (fluff or raveling generation), distortion, cost, and the like.

In addition, the ink absorbing amount of the absorbing member 12 is the total of the amount of ink held between the fibers of the absorbing member 12 and the amount of ink held in the valley portion 12*b*. For this reason, the material forming the absorbing member 12 is selected so that the ink absorbing amount is sufficiently larger than the amount of the ink ejected during the flushing operation in consideration of the exchange frequency of the absorbing member 12.

In this instance, the amount of ink held between the fibers of the absorbing member 12 and the amount of ink held in the valley portion 12*b* may be determined by the contact angle between the ink and the fiber, and the capillary force between the fibers depending on the surface tension of the ink. That is, when the absorbing member 12 is formed by thin fibers, the gap between the fibers increases and the surface area of the fiber increases. Accordingly, even when the sectional area of the absorbing member 12 is uniform, the absorbing member 12 is capable of absorbing a larger amount of ink. As a result, in order to obtain more gaps between the fibers, a micro fiber (ultrafine fiber) may be used as the fiber forming the fiber bundle 12*a*.

However, the ink holding force of the absorbing member 12 decreases since the capillary force decreases due to an increase in gap between the fibers. For this reason, it is necessary to set the gap between the fibers so that the ink holding force of the absorbing member 12 is equal to a degree that ink is not dropped due to the movement of the absorbing member 12.

Furthermore, the thickness (diameter) of the absorbing member 12 is set to, for example, about 5 to 75 times larger than the diameter (nozzle diameter) of the nozzle 24. In general printers, the gap between each nozzle surface 23 and the printing sheet in each of the printing heads 21A to 21E is set to about 1 mm to 2 mm, and the nozzle diameter is set to about 0.02 mm. Accordingly, if the diameter of the absorbing member 12 is 0.5 mm or less, the absorbing member 12 can be interposed between each nozzle surface 23 and the printing sheet, without coming into contact with each nozzle surface 23 or the printing sheet. If the diameter is 0.2 mm or more, the absorbing member is able to reliably capture the ejected ink droplets even when taking into consideration of a certain degree of tolerance in components. For this reason, it is preferable that the absorbing member 12 has the thickness (diameter) of about 0.2 mm to 0.5 mm, that is, 10 to 25 times larger than the nozzle diameter. The cross section of the absorbing member 12 may not necessarily be formed in a circular shape, but may be formed in a polygonal shape, since it is difficult to form the absorbing member in a perfect circular shape. A substantial circular shape is also included as a circle.

In addition, it is desirable that the absorbing member 12 has a length sufficient for the effective printing width of the head unit 2. Although it is described later in detail, the printer 1 according to this embodiment has a configuration in which the used region (after completing ink absorption region) of the absorbing member 12 is sequentially wound, and the whole absorbing member 12 is exchanged in the case where ink is absorbed by the entire region of the absorbing member 12. For this reason, it is desirable that the length of the absorbing member 12 is about several hundreds of times longer than the effective printing width of the head unit 2 so that the exchange time of the absorbing member 12 is practically sustainable.

Further, the absorbing member 12 having the above configuration is supported by the support mechanism 9, as shown in FIGS. 5A and 5B.

The support mechanism 9 includes a running mechanism 13 and a moving mechanism 14 which are provided at both sides of the head unit 2, that is, at one side and the other side in the arrangement direction of the printing head 21 in this embodiment. FIGS. 5A and 5B do not illustrate a portion of the head unit 2, and illustrate only two printing heads 21. In addition, FIGS. 5A and 5B illustrate eight nozzle rows L in total, in which two nozzle rows L are formed for each color of (Y), (M), (C), and (Bk), with respect to the printing head 21 constituting the head unit 2.

The running mechanism 13 is installed on a pair of support substrates 15A and 15B which are coupled to both sides of the head unit 2, and runs the absorbing member 12 in the direction along the nozzle row L of the printing head 21, that is, on a straight line parallel with the nozzle row L from one side to the other side.

The running mechanism 13 includes a delivery reel (delivery rotation body) 16 and a delivery motor (delivery driving unit) 16A for driving the delivery reel at the support substrate 15A of one side, and a winding reel (winding rotation body) 17 and a winding motor (winding driving portion) 17A for driving the winding reel at the support substrate 15B of the other side. The absorbing member 12 of a predetermined length is already wound around the delivery reel 16. If the absorbing member 12 is unwound from this state, the absorbing member 12 is delivered to the head unit 2 side. The winding reel 17 winds the absorbing member 12 delivered from the delivery reel 16.

Figure 7:
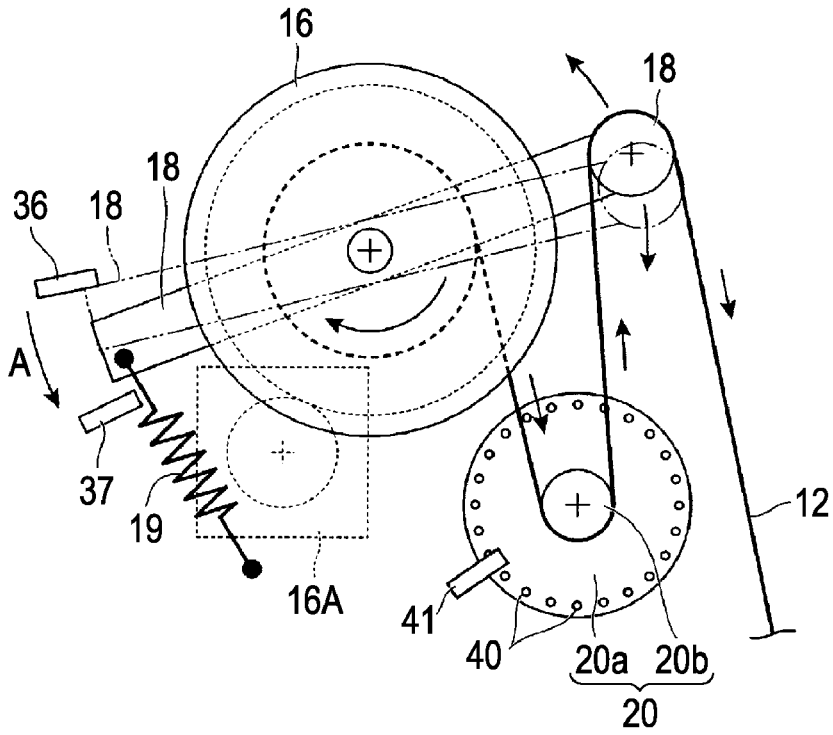
FIG. 7 is an enlarged view illustrating the main parts of FIGS. 5A and 5B.

In addition, as shown in FIG. 7 which is an enlarged view of the main parts, the support substrate 15A is provided with an adjusting lever (tension adjusting member) 18 for applying a predetermined tension to the absorbing member 12. The adjusting lever 18 is formed in the shape of an elongated plate, and is adapted to pivot around the center portion thereof as a pivot shaft in a forward or rearward direction. Further, the adjusting lever 18 is placed (at the support substrate 15A side)

below the delivery reel 16, and the pivot shaft coincides with the rotation shaft of the delivery reel 16.

The adjusting lever 18 is connected to a tension spring (second biasing member) 19 of a coil spring at one end side thereof, and is provided at the other end side with a roller 18*a* in a rotatable manner. The tension spring 19 is connected to the adjusting lever 18 at one end portion thereof, and is fixed to the support substrate 15A at the other end portion, thereby biasing the one end portion of the adjusting lever 18 in the direction indicated by the arrow A in FIG. 7. With the configuration, the adjusting lever 18 is biased by the tension spring 19 so as to pivot in the direction of the arrow A. In this way, the adjusting lever 18, the roller 18*a*, and the tension spring 19 serve as a tension applying mechanism for applying the predetermined tension to the absorbing member 12, as described below.

Both sides of one end portion of the adjusting lever 18, that is, both sides in the pivot direction, are provided with a first sensor 36 and a second sensor 37 at a position which is able to come into contact with the end portion. The first sensor 36 is placed at the side opposite to the direction of the arrow A with respect to one end portion of the adjusting lever 18, and the second sensor 37 is placed at the side in the direction of the arrow A with respect to one end portion of the adjusting lever 18. The first sensor 36 and the second sensor 37 serve as a limit switch which is turned on if it is pressed by one end portion of the adjusting lever 18, and is turned off if it is released from the press. The press resistance of the first sensor 36 and the second sensor 37 is sufficiently small. Accordingly, when these sensors are pressed by one end portion of the adjusting lever 18, the sensors do not resist against most of the pressing pressure, but back down. If the pressing pressure is released, the sensors return smoothly to the original positions thereof. In this embodiment, a sensor unit is formed by the first sensor 36 and the second sensor 37.

Moreover, the first sensor 36 and the second sensor 37 are provided so as to maintain the tension of the absorbing member 12 within a predetermined range, which will be described below. If the first sensor 36 is turned on, the winding motor 17A stops to drive. If the first sensor is turned off, the winding motor 17A is driven. In addition, if the second sensor 37 is turned on, the delivery motor 16A stops to drive, and simultaneously, the driving motor 17A is driven.

The ON-position of the first sensor 36, in this embodiment, that is, the position in which one end portion of the adjusting lever 18 comes into contact with the first sensor 36 to press the first sensor to a predetermined amount, is regarded as a first position in a displacement (pivot) range of the adjusting lever 18. The ON-position of the second sensor 37, that is, the position in which one end portion of the adjusting lever 18 comes into contact with the second sensor 37 to press the second sensor to a predetermined amount, is regarded as a second position in the displacement (pivot) range of the adjusting lever 18. The first position and the second position are respectively determined in response to the previously set tension range of the absorbing member 12 which will be described below.

The roller 18*a* of the adjusting lever 18 at the other end side becomes a holding position in which the absorbing member 12 is movably held, and the roller 18*a* can turn the absorbing member 12 which is unwound (delivered) from the delivery reel 16. The absorbing member 12 can be turned around the inspection rotation body 20 prior to the roller 18*a*. The inspection rotation body 20 includes a rotation plate 20*a* and a roller 20*b* which have the same rotation shaft and thus are integrally formed. The inspection rotation body 20 turns the absorbing member 12, which is unwound from the delivery reel 16, around the roller 20*b*. In other words, after the absorbing member 12 unwound from the delivery reel 16 is turned around the roller 20*b*, the absorbing member turns around the roller 18*a* of the adjusting lever 18.

When the absorbing member 12 runs, the roller 20*b* of the inspection rotation body 20 is rotated together with the absorbing member. Accordingly, the rotation plate 20*a* which is integrally formed with the roller 20*b* is rotated in the same speed (revolution) as the roller 20*b*. The rotation plate 20*a* is provided at the outer circumferential portion thereof with a plurality of holes (identifiers) 40 for pulse generation at regular intervals (predetermined interval) along a circumferential direction. In addition, a detecting unit 41 for detecting the holes 40 is placed at a position facing a portion of the outer circumferential portion of the rotation plate 20*a*. The detecting unit 41 includes, for example, a light emitting portion placed at one side of the rotation plate 20*a*, and a light receiving portion placed at the other side. If the light emitted from the light emitting portion passes through the hole of the rotating rotation plate 20*a*, the light is received by the light receiving portion.

With the configuration, the detecting unit 41 can detect the revolution of the rotation plate 20*a* based on the number of the detected holes. In addition, in order to rotate the roller 20*b* together with the absorbing member 12, the running length (running distance) of the absorbing member 12 is directly proportional to the revolution of the rotation plate 20*a*. Accordingly, it is possible to accurately detect the running length of the absorbing member 12 by detecting the revolution of the rotation plate 20*a*, as described above. In this embodiment, the detection mechanism of this embodiment includes the detecting unit 41 and the holes (identifiers) 40 of the rotation plate 20*a*.

The absorbing member 12 rotating around the roller 20*b* is delivered to the roller 18*a* at the other end side of the adjusting lever 18, as described above, and then rotates around the roller. As shown in FIGS. 5A and 5B, the absorbing member is delivered to the moving mechanism 14.

The moving mechanism 14 includes a pair of moving mechanism sections 53A and 53B which are respectively provided at both sides of the head unit 2. The absorbing member 12 rotates sequentially around positioning rollers (positioning member) 54*a* and 54*b* which are respectively provided at the moving mechanism sections 53A and 53B. The moving mechanism 14 will be described in detail below.

The absorbing member 12, which rotates around the positioning roller 54*a* in the moving mechanism section 53A of the support substrate 15A side, passes through the side facing the head unit 2, and then rotates around the positioning roller 54*b* in the moving mechanism section 53B of the support substrate 15B side, is wound around the winding reel 17. In this embodiment, the absorbing member 12 rotating around the positioning roller 54*b* passes via a safety lever 44 which is placed between the positioning roller 54*b* and the winding reel 17, and then is wound around the winding reel 17.

Figure 8:
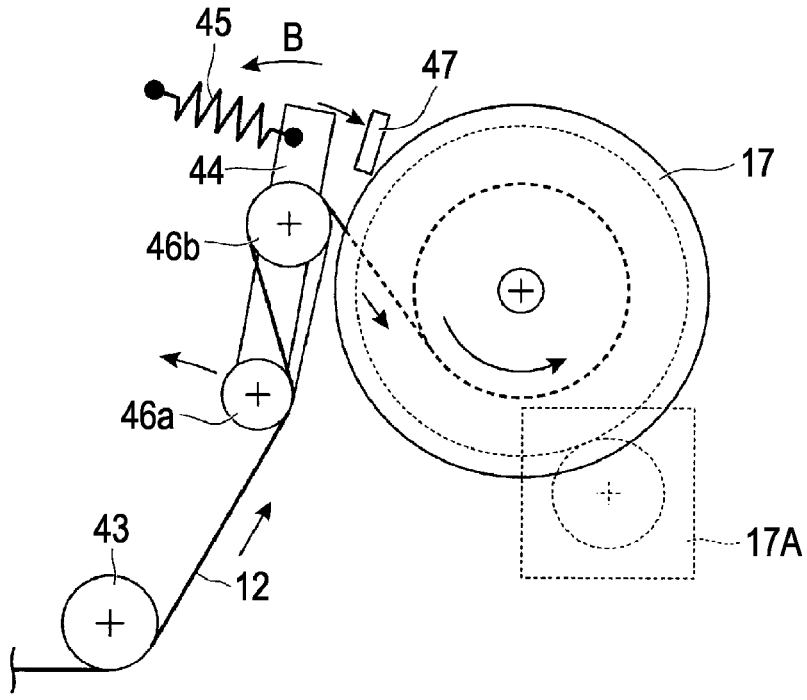
FIG. 8 is an enlarged view illustrating the main parts of FIGS. 5A and 5B.

The safety lever 44 is formed in the shape of an elongated plate, as shown in FIG. 8 which is an enlarged view of the main parts. The safety lever 44 is adapted to pivot around the center portion thereof as a pivot shaft in a forward or rearward direction. One end portion of the safety lever 44 is connected to a tension spring (tension spring) 45 which is made of a coil spring, and the other end portion is provided with a roller 46*a* in a rotatable manner. In addition, a separate roller 46*b* is rotatably provided at one end side from the pivot shaft (not illustrated).

One end side of the tension spring 45 is connected to the safety lever 44, and the other end side is fixed to the support substrate 15B, so that the one end side of the safety lever 44 is biased in the direction indicated by the arrow B in FIG. 8. With the configuration, the safety lever 44 is biased by the tension spring 45 to pivot in the direction of the arrow B.

One end portion of the safety lever 44, which is opposite to the tension spring 45, is provided with a safety sensor portion 47 at a position in which the safety sensor portion comes into contact with the one end portion. The safety sensor portion 47 is a limit switch in which if the safety sensor portion 47 is pressed by the one end portion of the safety lever 44, the safety sensor portion is turned on, while if the press is released, the safety sensor portion is turned off. The safety sensor portion 47 is adapted to stop to drive the winding motor 17A if it is turned on. In this embodiment, the safety mechanism is formed by the safety lever 44, the tension spring 45, the rollers 46*a* and 46*b*, and the safety sensor portion 47.

According to the safety mechanism, if the tension of the absorbing member 12 rotating around the rollers 46*a* and 46*b* is equal to or more than the predetermined level, one end side of the safety lever 44 pivots in a direction opposite to the arrow B while resisting against the biasing force of the tension spring 45. If the safety sensor portion 47 is pressed and then is turned on, the driving of the winding motor 17A is stopped, and the rotation of the winding reel 17 is stopped. In this way, it is possible to prevent the absorbing member 12 from being cut, due to the pulling thereof beyond the limit, as described below.

As shown in FIGS. 5A and 5B, the position of the absorbing member 12 opposite to the head unit 2 is determined by the positioning roller 54*a* of the support substrate 15A and the positioning roller 54*b* of the support substrate 15B which serve as the moving mechanism 14.

The moving mechanism 14 is formed by the pair of moving mechanism sections 53A and 53B, as described above. The moving mechanism sections 53A and 53B move the absorbing member 12 parallel from the reference position in the head unit 2 shown in FIG. 5A to the predetermined position in the head unit 2 shown in FIG. 5B, and move the absorbing member parallel from the predetermined position to the reference position.

That is, the moving mechanism sections 53A and 53B include moving stages (moving member) 55A and 55B which are provided to reciprocate in a direction R intersecting (in this embodiment, perpendicular to) an extension direction P of the nozzle row L in the printing head 21 of the head unit 2, and the positioning rollers 54*a* and 54*b* which are provided at the moving stage members 55A and 55B to reciprocate along the direction R, and pressing springs (first biasing member) 56 for biasing the positioning rollers 54*a* and 54*b* from the reference position side to the predetermined position side in the direction R.

The moving stages 55A and 55B are adapted to reciprocate in the direction R by a male ball screw 57 and a motor 58 which rotates the ball screw 57 in a forward or rearward direction. The motor 58 includes a stepping motor, or the like, and is fixed to the support substrates 53A and 53B. The moving stages 55A and 55B have a surface of the support substrates 53A and 53B side that come into sliding contact therewith, and have a female screwed portion (not illustrated) which is screwed with the ball screw 57. With the configuration, if the ball screw 57 is rotated by the motor 58, the moving stages 55A and 55B can reciprocate in the direction R, as described above.

The reference position shown in FIG. 5A is regarded as a position further out than the nozzle surface 23 of the printing head 21 at one side in the direction R, that is, at the printing head 21 in which the roller 18*a* of the adjusting lever 18 is placed in this embodiment. In addition, the predetermined position is regarded as a position facing the nozzle surface 23 of the printing head 21, specifically, a position along the nozzle row L, at the other side in the direction R, as shown in FIG. 5B.

Due to the position along the nozzle row L, the predetermined position is the flushing position in which the flushing undergoes from each nozzle 23 constituting the nozzle row L. The flushing position is regarded as a position in which the ink droplets ejected from the nozzle row L are received and absorbed by the absorbing member at the flushing operation, in the state in which the absorbing member 12 shown in FIG. 9 faces (at a plan view, is overlapped on) the corresponding nozzle row L (the plurality of nozzles 24 constituting the nozzle row L), that is, a position on the flight path of the ink.

Meanwhile, the expression "the nozzle row L faces the absorbing member 12" does not only mean the state where the center of the nozzle 24 is always overlapped on the center of the absorbing member 12 at a plan view, but means the state where the nozzle 24 is positioned in the width of the absorbing member 12 at a plan view. In such a state, the absorbing member 12 can absorb the ink ejected from the nozzles 24.

While the predetermined position becomes the flushing position, the reference position is a retraction position, in which the ink droplets for printing ejected from each nozzle 24 is not absorbed by the absorbing member 12 at the printing operation, in the state where it does not face (at a plan view, is not overlapped on) the nozzle row L (the plurality of nozzles 24 constituting the nozzle row L).

Since the flushing position becomes the predetermined position, as described above, all positions corresponding to each nozzle row L formed on the printing head 21, that is, the position along each of eight nozzle rows L becomes the predetermined position in this embodiment, as the predetermined position with respect to the reference position. Meanwhile, the reference position is one position shown in FIG. 5A in this embodiment.

The moving mechanism sections 53A and 53B according to this embodiment are able to move the absorbing member 12 from the reference position to the predetermined positions of eight places. Position detecting sensors (not illustrated) for detecting the mutual position are provided at eight stop positions or the moving stages 55A and 55B. In this way, if the desired stop position is detected, the moving stages 55A and 55B accurately stop the movement at the stop position.

In the moving mechanism sections 53A and 53B, the ball screw 57 is rotated by the rotation of each motor 58, and the moving stages 55A and 55B screwed with the ball screw 57 are moved in the longitudinal direction of the ball screw 57, that is, in the direction R in FIGS. 5A and 5B. At that time, the motors 58 and 58 are controlled by a control unit (not illustrated) to be synchronously operated, and thus, the moving stages 55A and 55B are simultaneously moved in the same direction and at the same distance in the direction R. Since the motor 58 is able to rotate in a forward or rearward direction, the moving stages 55A and 55B or the absorbing member 12 can also be moved toward both sides in the direction R.

In addition, the positioning stages 55A and 55B are provided with an elongated hole 59 along the direction R, and the positioning rollers 54*a* and 54*b* are movably provided in the elongated hole 59. The positioning rollers 54*a* and 54*b* determine the position of the absorbing member 12 in the direction R by rotating and holding the absorbing member 12 between the positioning rollers. In this embodiment, the positioning rollers 54*a* and 54*b* are adapted to hold the absorbing member 12 at the side opposite to the roller 18*a* of the adjusting lever 18, and thus the holding position is controlled to be the reference position or the predetermined position.

Further, the positioning rollers 54*a* and 54*b* are connected to the pressing spring 56, as described above. The pressing spring 56 biases the positioning rollers 54*a* and 54*b* from the reference position side to the predetermined position side. Accordingly, the positioning rollers 54*a* and 54*b* are biased to move from the reference position side to the predetermined position side in the elongated hole 59. The elongated hole 69 has an unopened end portion, and thus the positioning rollers 54*a* and 54*b* are able to move only in the range of the elongated hole 69 in the longitudinal direction thereof. Accordingly, since the positioning rollers 54*a* and 54*b* are generally pressed (biased) by the pressing spring 56, the positioning rollers 54*a* and 54*b* can be stopped at the edge (of predetermined position side) opposite to the reference position in the elongated hole 69. In other words, the positioning rollers 54*a* and 54*b* have the stop position formed by the edge of the elongated hole 59 at the predetermined position side in the direction R.

The positioning rollers 54*a* and 54*b* hold the absorbing member 12 therebetween, but if the absorbing member 12 is biased toward the reference position side in the direction R by the tension of the absorbing member 12, that is, the tension applied by holding the absorbing member 12 between the delivery roller 16 and the winding roller 17, and the tension applied via the adjusting lever 18 by the tension spring 19 connected to the adjusting lever 18, the absorbing member can be moved from the stop position to the reference position side in the elongated hole 59. In other words, if the biasing force of the absorbing member 12 is stronger than the biasing force of the pressing spring 56, the positioning rollers 54*a* and 54*b* are moved toward the reference position side in the elongated hole 59.

Since the adjusting lever 18 is biased by the tension spring 19 to pivot in the direction of the arrow A, the tension of the absorbing member 12 held between the positioning rollers 54*a* and 54*b* can be increased by the roller 18*a*. Accordingly, the adjusting lever 18, the roller 18*a*, and the tension spring 19 serve as the tension applying mechanism which applies the predetermined tension to the absorbing member 12.

Next, the operation of the printer 1 according to the embodiment associated with the running operation of the absorbing member 12 by the running mechanism 13 and the moving operation of the absorbing member 12 by the moving mechanism 14 will be described. Meanwhile, the operation of the printer 1 according to the embodiment is wholly controlled by a control device (control unit) which is not illustrated herein.

First, the running operation of the absorbing member 12 by the running mechanism 13 will be described.

Figure 9:
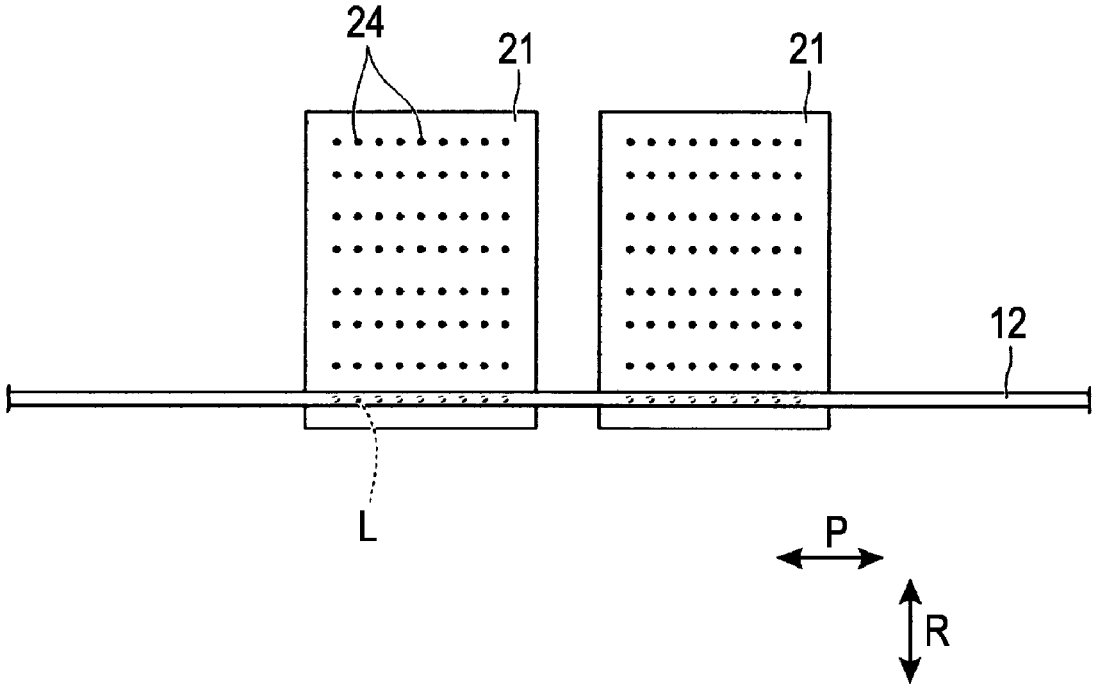
FIG. 9 is a view illustrating a flushing position.

After the flushing is completed in the state shown in FIG. 9, the absorbing member 12 is moved by the moving mechanism 14 from the flushing position (predetermined position) shown in FIG. 5B to the retraction position (reference position) shown in FIG. 5A in preparation for the ejection of the ink onto the printing sheet by the printing head 21. At that time, since the driving of the delivery motor 16A is stopped and only the winding motor 17A is rotated, the tension of the absorbing member 12 held between the delivery reel 16 and the winding reel 17 is maintained at the predetermined tension set in advance. In other words, if the absorbing member 12 is moved from the flushing position (predetermined position) shown in FIG. 5B to the retraction position (reference position) shown in FIG. 5A, the moving stages 55A and 55B come together close to the delivery reel 16 and the winding reel 17, and thus the path of the absorbing member 12 held between the delivery reel 16 and the winding reel 17 is shortened, so that the tension is reduced in strength (weakened).

Therefore, the tension of the absorbing member 12 is increased (strengthened) by the amount corresponding to the shortened path and the winding of the absorbing member 12 by the winding motor 17A, the absorbing member is exerted by the predetermined tension set in advance. In the state where the absorbing member 12 is held with the predetermined tension set in advance, the positioning rollers 54*a* and 54*b* are pressed by the pressing spring 56, and thus are stayed in the stop position.

The variation in tension of the absorbing member 12 due to the operation of the moving mechanism 14 will be described in detail hereinafter.

In addition, when the absorbing member is moved to the retraction position (reference position), as shown by the double-dashed line in FIG. 7, the adjusting lever 18 is in the state where the first sensor 36 is turned on, in other words, the adjusting lever 18 reaches the first position within the displacement range. Accordingly, since the adjusting lever 18 is shifted to the side opposite to the direction of the arrow A by the force of the absorbing member 12 more than by the biasing force of the tension spring 19, the tension is equal to or more than the first tension corresponding to the biasing force of the tension spring 19.

Under such a state, for example, in order to wind the region, which absorbs and receives the ink in advance by the flushing operation, around the winding reel 17 side, and face a new region, which does not yet absorb and receive the ink, with the head unit 2, the delivery motor 16A is driven, and then the delivery reel 16 is rotated. Since the winding reel 17 is stopped, the unwinding amount (delivery amount) of the absorbing member 12 unwound between the delivery reel 16 and the winding reel 17 is increased (lengthened), and thus the tension of the absorbing member 12 is weakened.

As a result, in order to be less than the first tension, as indicated by a solid line in FIG. 7, the adjusting lever 18 is apart from the first position, and reaches between the first position and the second position (position in which the second sensor 37 is turned on). If the adjusting lever 18 is apart from the first position, the first sensor 36 detects it to drive the winding motor 17A, so that the winding reel 17 is rotated. Accordingly, since the delivery reel 16 and the winding reel 17 are rotated together, the tension of the absorbing member 12 is stabilized, and the displacement of the adjusting lever 18 is maintained within the predetermined range, and thus is maintained between the first position and the second position, as indicated by the solid line in FIG. 7.

Since each revolution of the delivery motor 16A and the winding motor 17A is set substantially equal in advance, each revolution of the delivery reel 16 and the winding reel 17 are substantially the same. The winding amount of the absorbing member 12 wound around the delivery reel 16 and the winding reel 17 is set in such a manner that the winding amount is high at the delivery reel 16 side in the initial stage, but goes on increasing at the winding reel 17 side with repeated use. Accordingly, since there is a difference in the winding amount between the delivery reel 16 and the winding reel 17, the winding diameter of the absorbing member 12 is varied, and thus, even though the delivery reel 16 and the winding reel 17 are rotated at an equal revolution, a difference happens between the delivery length (unwinding length) per unit of time and the winding length per unit of time due to the difference in winding diameter. Accordingly, it is difficult to maintain the length of the absorbing member 12 held between the delivery reel 16 and the winding reel 17 uniformly at any time only by controlling the revolution of the delivery motor 16A and the revolution of the winding motor 17A respectively. In fact, the held length is slightly and continuously varied.

For example, the delivery length is longer than the winding length, the tension of the absorbing member 12 is further weakened, and is equal to or lower than the second tension which is weaker than the first tension. The first tension and the second tension are set in such a manner that the upper limit in the preferred tension range of the absorbing member 12 held between the delivery reel 16 and the winding reel 17 is set as the first tension, while the lower limit is set to the second tension.

If the tension of the absorbing member 12 is equal to or lower than the second tension, the adjusting lever 18 reaches the second position, and the second sensor 37 is turned on. Since the second sensor 37 is turned on, the delivery motor 16A is stopped, and the driving of the winding motor 17A is maintained (the winding motor 17A is driven). In this way, the absorbing member is held (delivered) between the delivery reel 16 and the winding reel 17. Since the unwinding length (amount) of the absorbing member 12 is shortened (reduced), the tension is strengthened, and thus is equal to or higher than the second tension.

As a result, the adjusting lever 18 is apart from the second position, and then again reaches between the first position and the second position. If the adjusting lever 18 is apart from the second position, the second sensor 37 detects it, and then is turned off, so that the delivery motor 16A is driven and the delivery motor 16 is rotated. Accordingly, the delivery reel 16 and the winding reel 17 are together rotated, the tension of the absorbing member 12 is stabilized, and the displacement of the adjusting lever 18 is maintained within the predetermined range.

In addition, for example, if the delivery length is shorter than the winding length, the tension of the absorbing member 12 is increased, and thus is equal to or higher than the first tension again. Then, the adjusting lever 18 again reaches the first position, and the first sensor 36 is again turned on. If the first sensor 36 is turned on, the delivery motor 16A is stopped, and the driving of the winding motor 17A is maintained (the winding motor 17A is driven). In this way, the absorbing member is held (unwound) between the delivery reel 16 and the winding reel 17. Since the unwinding length (amount) of the absorbing member 12 is lengthened (increased), the tension s weakened, and thus is less than the first tension.

Even though the tension of the absorbing member 12 is increased and thus is equal to or higher than the first tension, since the first sensor 36 is turned on and thus the delivery motor 16A is stopped for a moment, the absorbing member 12 is almost maintained with the predetermined tension set in advance. Accordingly, the positioning rollers 54*a* and 54*b* are still stayed in the stop position.

If the tension of the absorbing member 12 is decreased and thus is less than the first tension, the adjusting lever 18 is apart from the first position, and then again reaches between the first position and the second position. If the adjusting lever 18 is apart from the first position, the first sensor 36 detects it, and then is turned off, so that the winding motor 17A is driven and the winding reel 17 is rotated. Accordingly, the delivery reel 16 and the winding reel 17 are together rotated again, the tension of the absorbing member 12 is stabilized, and the displacement of the adjusting lever 18 is maintained within the predetermined range.

Therefore, if the tension of the absorbing member 12 is varied beyond the range of the first tension and the second tension set in advance, the displacement of the adjusting lever 18 exceeds the predetermined range between the first position and the second position. Since it is detected by the first sensor 36 or the second sensor 37, the driving and the stopping of the deliver reel 16 (deliver motor 16A) and/or the winding reel 17 (winding motor 17A) is automatically controlled. In this way, since the displacement of the adjusting lever 18 is adjusted to return to the predetermined range, the tension of the absorbing member 12 is stabilized within the predetermined range.

In addition, in the case where the running of the absorbing member 12 by the running mechanism 13 is stopped, the control device is already controlled (commanded) to stop the delivery motor 16A as the end operation. Since only the winding motor 17A is driven and only the winding reel 17 is rotated, the absorbing member is held (unwound) between the delivery reel 16 and the winding reel 17. The unwinding length (amount) of the absorbing member 12 is shortened (reduced) and thus the tension is increased and is equal to or higher than the first tension. Then, the adjusting lever 18 again reaches the first position, and thus the first sensor 36 is turned on. Since the first sensor 36 is turned on, the delivery motor 16A is stopped.

Normally, the first sensor 36 is turned on to drive the winding motor 17A. However, here it is the end time, and since the control device is already received with the command for the end operation, the winding motor 17A is not driven, and is maintained in a stopped state. Accordingly, the adjusting lever 18 turns the first sensor 36 on, as indicated by the double-dashed line in FIG. 7. In other words, the adjusting lever 18 reaches the first position in the displacement range.

In this way, the absorbing member 12 is always maintained with the constant tension at the end time, and thus the behavior of the absorbing member 12 is not changed due to the variation of the tension, and thus vibration or the like is not generated on the absorbing member.

In addition, at the end time, that is, in the state where the absorbing member 12 is stopped to run when the absorbing member 12 is equal to or higher than the first tension and the adjusting lever 18 is in the first position, if the absorbing member 12 is stretched due to plastic deformation, the tension of the absorbing member 12 is decreased, and thus is less than the first tension. Accordingly, as described above, since the adjusting lever 18 is apart from the first position, the winding motor 17A is driven, and the winding reel 17 is rotated. The absorbing member 12 is wound around the winding reel 17 by the amount corresponding to the stretched amount, and thus the tension of the absorbing member 12 is again equal to or higher than the first tension. In this way, the adjusting lever 18 again reaches the first position, and the winding motor 17A is again stopped. Accordingly, for example, the tension of the absorbing member 12 is maintained in the stabilized state for a long stop time.

Further, if the absorbing member 12 run by unwinding the absorbing member 12 from the delivery reel 16 and winding the absorbing member around the winding reel 17, the absorbing member 12 is rotated around the roller 20*b* of the inspection rotation body 20, as described above, in a way from the delivery reel 16 to the roller 18*a* of the adjusting lever 18.

At that time, since the roller 20*b* is together rotated by the running of the absorbing member 12, the inspection rotation body 20 is rotated in response to the running length (running distance) of the absorbing member 12. Since the revolution of the inspection rotation body 20 is directly proportional to the running length (running distance) of the absorbing member 12, it is possible to accurately detect the running length of the absorbing member 12 by detecting the hole 40 of the rotation plate 20*a* by the detecting portion 41.

As described above, in order to wind the region, which absorbs and receives the ink in advance by the flushing operation, around the winding reel 17 side, and face a new region, which does not yet absorb and receive the ink, with the head unit 2, when the delivery motor 16A is driven, and the delivery reel 16 is rotated, for example, the length of the region, which absorbs and receives the ink, is set to the delivery amount of the absorbing member 12. The running length of the absorbing member 12 actually run is detected by the inspection mechanism including the inspection rotation body 20, the detecting portion 41 and the hole 40 of the rotation plate 20*a*. If the detected value is the set delivery amount, the end operation is carried out by the control device, as described above.

With the above configuration, it is possible to prevent the decrease of use efficiency of the absorbing member 12 from decreasing, due to the absorbing member 12 being delivered (run) more than necessary and sent to the winding reel 17, and thus the winding region of the absorbing member is extended while not absorbing the ink.

In addition, it is considered to detect the length of the running absorbing member 12 only by detecting the revolution of the delivery reel 16 or the winding reel 17, but, as described above, the winding amount of the absorbing member 12 wound around the delivery reel 16 or the winding reel 17 is varied with repeated use. Accordingly, in order to change the winding diameter thereof, the revolution of the delivery reel 16 or the winding reel 17 does not accurately correspond to the length of the running absorbing member 12. In order to accurately figure out the length of the running absorbing member 12 and prevent the deterioration in use efficiency of the absorbing member 12, the above-described inspection mechanism including the inspection rotation body 20, the detecting portion 41 and the hole 40 of the rotation plate 20*a* is effective.

In addition, since the absorbing member 12 passing through the side opposite to the head unit 2 and moving (running) to the support substrate 15B side is rotated around the positioning roller 54*b*, and then is rotated around the roller 46*a* and the roller 46*b* of the safety lever 44 in this order before the absorbing member is wound around the winding reel 17, if the tension of the absorbing member 12 is equal to or higher than the predetermined level by the safety mechanism including the safety lever 44, as described above, the winding motor 17A is stopped from driving.

That is, for example, if there is no remaining absorbing member 12 wound around the delivery reel 16 or the absorbing member 12 is unexpectedly caught, the tension of the absorbing member 12 is equal to or higher than the predetermined tension, and thus the positioning rollers 54*a* and 54*b* are moved toward the side opposite to the stop position against the pressing pressure (biasing force) of the pressing spring 56. If the tension of the absorbing member 12 is further increased, one end side of the safety lever 44 is pivoted in the direction opposite to the arrow B against the biasing force of the tension spring 45. Then, the safety sensor portion 47 is pressed and is turned on to stop the driving of the winding motor 17A, and the rotation of the winding reel 17 is stopped.

In this way, it is possible to avoid a disadvantage that the absorbing member 12 is torn by forcedly pulling the absorbing member 12.

In addition, after the flushing operation is carried out a plurality of times, most of the absorbing member 12 wound around the delivery reel 16 is wound by the winding reel 17, and if the winding of the absorbing member 12 around the winding reel 17 is completed, the absorbing member is replaced by a new one.

Figure 10A:
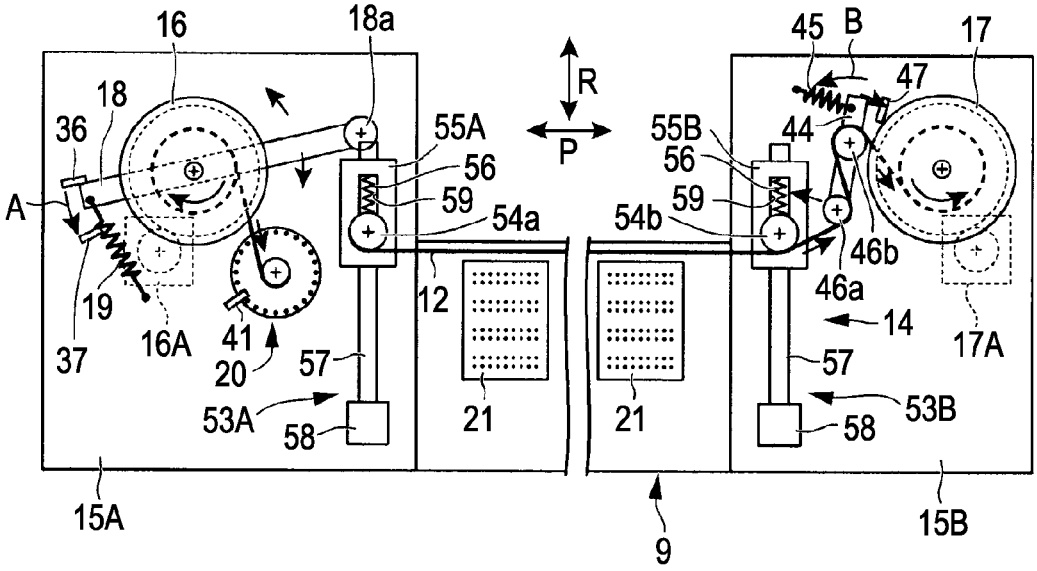
FIGS. 10A to 10D are views illustrating the operation of a moving mechanism.

Then, the moving operation of the absorbing member 12 by the moving mechanism 14 will be described with reference to FIGS. 10A to 10D. In FIGS. 10A to 10D, a part of the running mechanism 13 will be omitted so as to mainly describe the operation of the moving mechanism 14. In addition, FIG. 10A illustrates the same state as the state shown in FIG. 5A, and FIG. 10C illustrates the same state as the state shown in FIG. 5B.

After the absorbing member 12 is run in the state shown in FIG. 10A (FIG. 5A) to face the new region, which does not absorb and receive the ink, with the head unit 2, when the flushing is again carried out, the moving mechanism 14 is operated, and the motors 58 of the moving mechanism sections 53A and 53B are driven to move the absorbing member 12, for example, to the predetermined position shown in FIG. 5B, that is, the flushing position. In the initial stage of such a movement, the delivery roller 16 and the winding roller 17 are not together rotated, but are maintained in a stationary state.

And then, the moving stages 55A and 55B are moved from the reference position side to the predetermined position side along the direction R by the ball screw 57 which is rotated by the driving of the motor 58. If the moving stages can be moved by this way, the tension of the absorbing member 12 is strengthened (increased) by the extended path from the delivery roller 16 to the winding roller 17. In other words, the tension applied by the adjusting lever 18 or the tension spring 19 is strengthened. Due to the increased tension of the held absorbing member 12, the positioning rollers 54*a* and 54*b* are biased in the direction opposite to the pressing (biasing) direction exerted by the pressing spring 56. Since the increased speed of the tension of the absorbing member 12 is slower than the moving speed of the moving stages 55A and 55B, the relative moving speed of the absorbing member 12 is slow in proportion to the case where the tension is not varied.

Figure 10B:
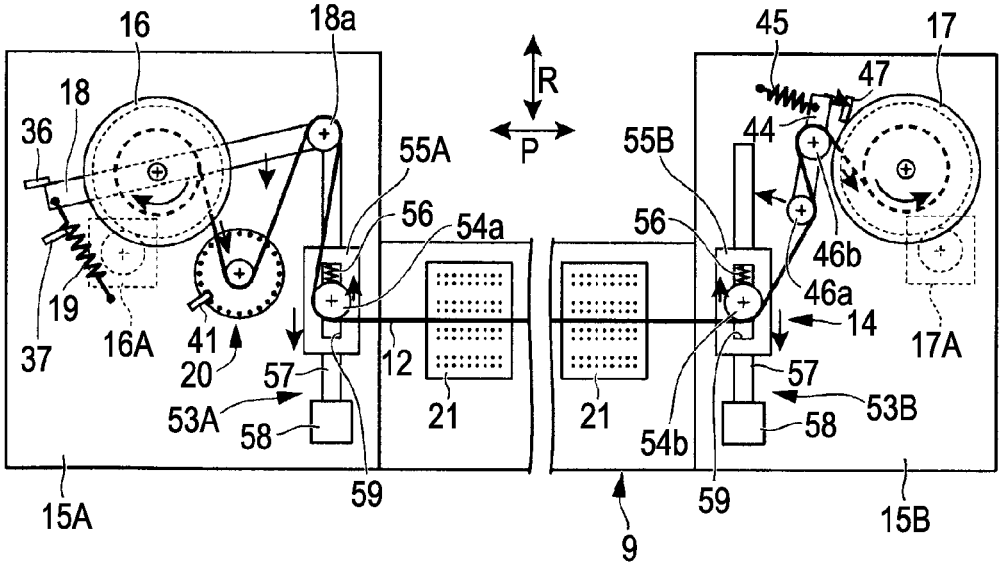
Figure 10C:
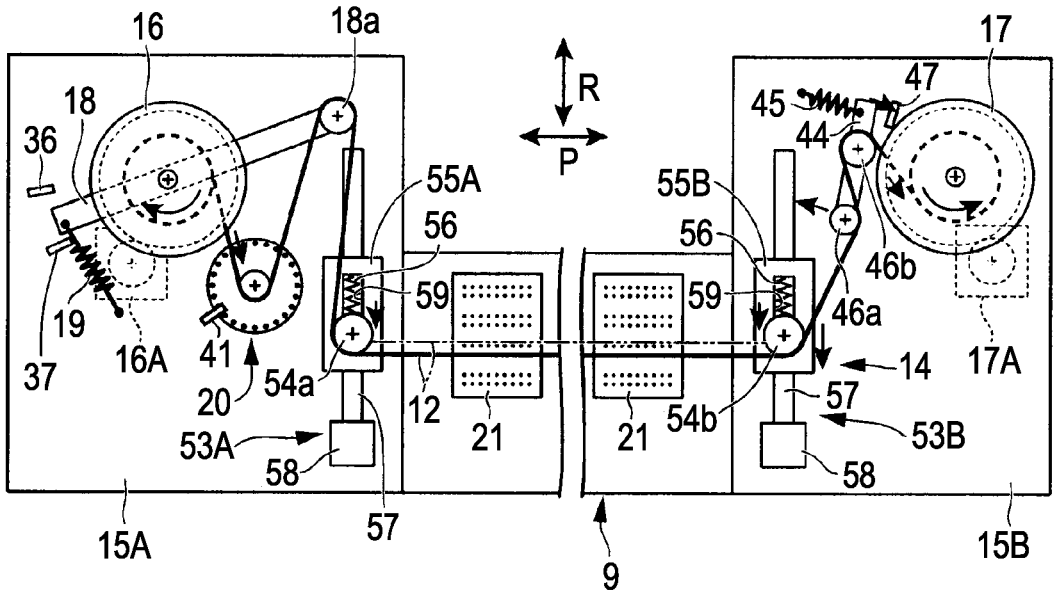

Then, for example, if a certain level of distance progresses, as shown in FIG. 10B to further strengthen the tension of the absorbing member 12, this is stronger than the biasing force of the pressing spring 56, and thus the positioning rollers 54*a* and 54*b* can be moved to the direction opposite to the biasing direction of the pressing spring 56, that is, the reference position side, with respect to the moving stages 55A and 55B.

Accordingly, from the initial stage of the movement to the middle stage of the movement, since the tension of the absorbing member 12 is increased by the adjusting lever 18 or the tension spring 19, the absorbing member 12 is moved slightly toward the side (reference position side) opposite to the moving direction (predetermined position side) of the moving stages 55A and 55B, so that the acceleration of the absorbing member 12 can be suppressed at the time of moving the moving stages 55A and 55B. Accordingly, as described above, since the relative moving speed of the absorbing member 12 is slow in proportion to the case where the tension is not varied, and the acceleration of the absorbing member 12 is suppressed, it is possible to suppress the vibration from being generated in the absorbing member 12.

In addition, if the positioning rollers 54*a* and 54*b* are moved in the direction opposite to the biasing direction of the pressing spring 56, it is possible to lessen the tension applied to the absorbing member 12 by the adjusting lever 18 or the tension spring 19. For example, the delivery motor 16A is driven at an appropriate timing after the moving stages 55A and 55B start to move, and then the delivery reel 16 is rotated to deliver the absorbing member 12, so that the length of the absorbing member is extended, and the moving stages 55A and 55B are moved to the desired position, that is, the stop position, as shown in FIG. 10C. In this way, the tension of the absorbing member 12 is balanced and is lessened slightly. If the tension of the absorbing member 12 is weaker than the biasing force of the pressing spring 56, the positioning rollers 54*a* and 54*b* can be moved to the predetermined position side, which is the biasing direction of the pressing spring 56, in the elongated hole 59. If the positioning rollers 54*a* and 54*b* reach the stop position, they are stopped there. Therefore, the absorbing member 12 reaches the position along the nozzle row L, that is, the flushing position which is the predetermined position, as indicated by the double-dashed line in FIG. 10C.

Now, therefore, in the end stage of the movement, since the tension applied to the absorbing member 12 is reduced by the adjusting lever 18 or the tension spring 19, the absorbing member 12 is moved slightly toward the moving direction (predetermined position side) of the moving stages 55A and 55B and then is stopped, thereby suppressing the deceleration at the time of stopping.

In this way, since the absorbing member 12 suppresses the acceleration at the initial stage of the movement or the deceleration at the end stage of the movement, the influence of the acceleration or the deceleration resulted from the movement of the absorbing member 12 is decreased, thereby minimally suppressing the vibration of the absorbing member which is generated at the time of the movement.

Figure 10D:
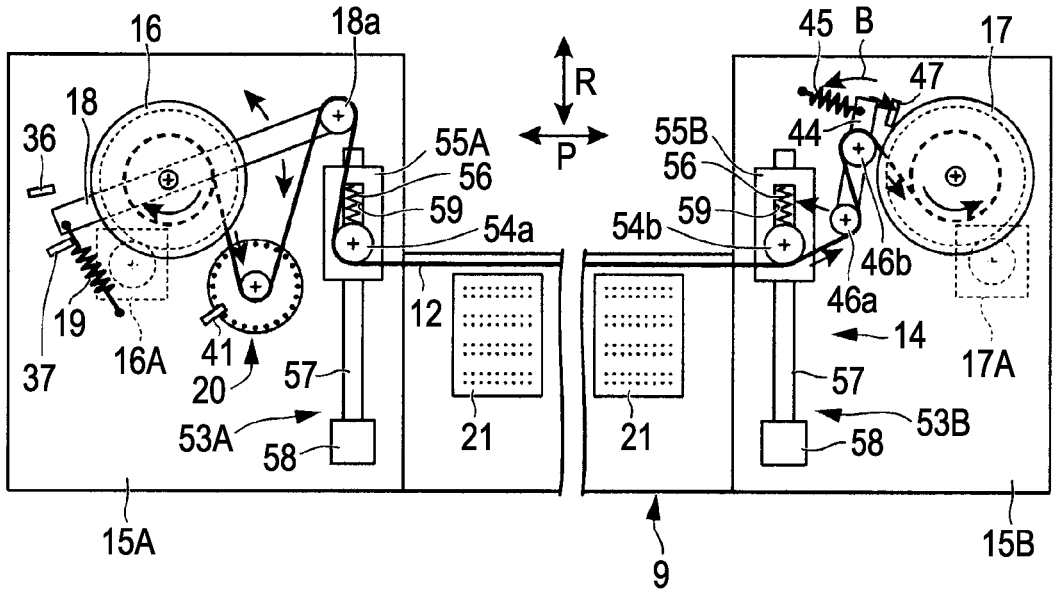

In addition, in order to move the absorbing member 12 to the flushing position, perform the flushing, and again move the absorbing member 12 to the retraction position which is the reference position, as shown in FIG. 10D, the motors 58 of the moving mechanism sections 53A and 53B are driven to move the moving stages 55A and 55B to the reference position side, and the winding motor 17A is driven to rotate the winding reel 17, thereby winding a predetermined length of the absorbing member 12.

At that time, since the movement of the moving stages 55A and 55B to the reference position side and the winding of the absorbing member 12 around the winding reel 17 are balanced to each other, it is possible to prevent the absorbing member 12 from abruptly moving to the retraction position (reference position) side, similar to the time of moving the absorbing member to the flushing position (predetermined position), thereby alleviating the moving speed of the absorbing member 12. Accordingly, it is possible to prevent the ink droplets from being scattered from the absorbing member 12 due to the absorbing member 12 absorbing the ink being vibrated.

As described above, according to the printer 1 of this embodiment, since the speed of the absorbing member 12 is gradually reduced, it is possible to alleviate the acceleration generated at the time of stopping or accelerating the absorbing member, and it is possible to automatically lessen the abrupt variation in the movement of the absorbing member 12 by the tension of the absorbing member 12 and the delivery thereof, and the scanning speed of the absorbing member 12 at the time of moving the absorbing member 12, without employing the control of a motor or the like for moving a different stage. Accordingly, the vibration is naturally left so as to solve it as in the related art, but the convergence time is shortened in the printer 1, thereby promoting the shortening of the flushing time. In addition, the scanning of the absorbing member 12 can be easily controlled.

Therefore, the vibration generated when the absorbing member 12 is moved between the retraction position and the flushing position can be suppressed by the simple mechanical mechanism, without using an expensive motor.

In addition, since the running length of the absorbing member 12 is accurately detected by the inspection rotation body 20 and the inspection mechanism, when the moving stages 55A and 55B are moved to cause the absorbing member 12 to move, for example, from the reference position which is the retraction position to the flushing position which is the predetermined position, the amount corresponding to the changed length of the absorbing member 12 according to the movement can be supplemented by rotating the delivery reel 16. At that time, since the delivery amount of the absorbing member 12 from the delivery reel 16 is precisely figured out, the amount corresponding to the changed length of the absorbing member 12 according to the movement can be accurately and appropriately supplemented. Therefore, it is possible to maintain the tension of the absorbing member 12 equally at the retraction position and the flushing position.

Next, a printer according to a second embodiment, serving as the fluid ejecting apparatus of the invention, will be described.

Figure 11:
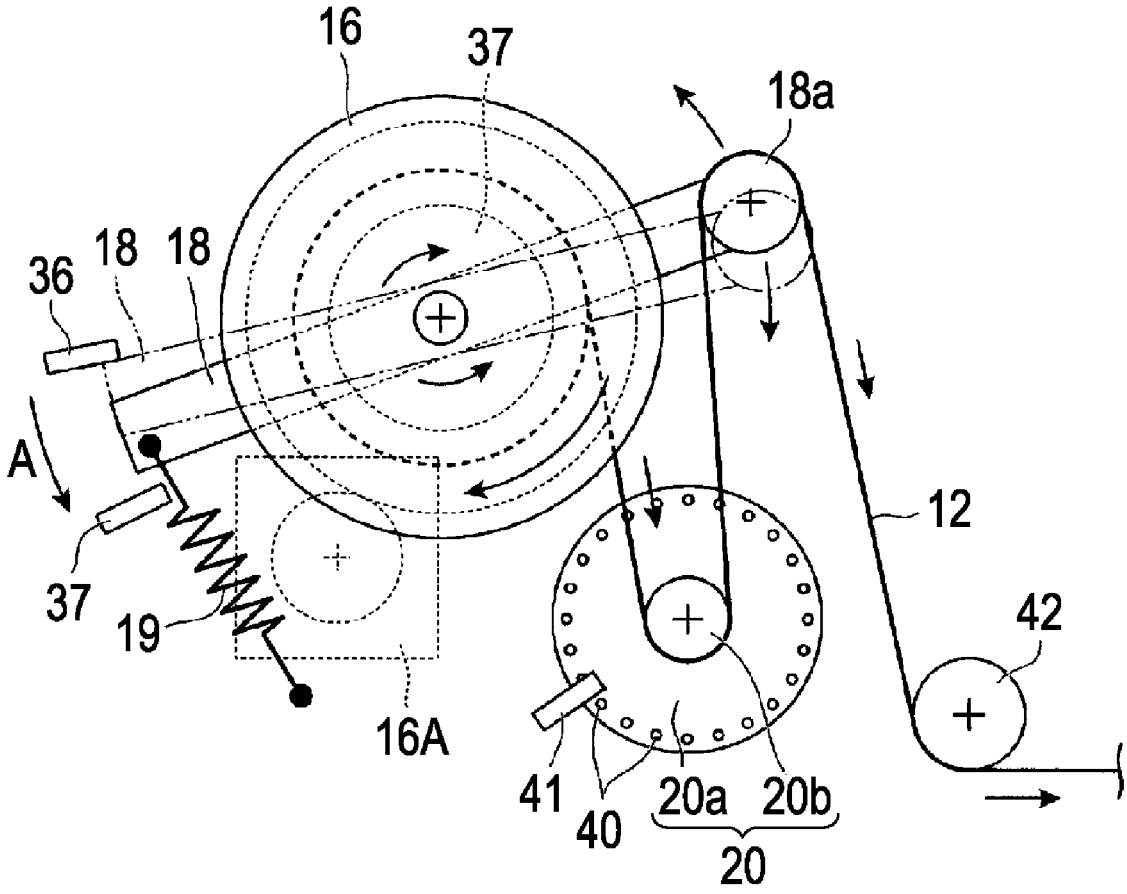
FIG. 11 is an enlarged view of the main parts illustrating a second embodiment.

FIG. 11 is an enlarged view of the main parts to illustrate the delivery reel 16 and the vicinity thereof in the printer according to the second embodiment.

The second embodiment shown in FIG. 11 is substantially similar to the first embodiment shown in FIG. 7, except that the sensor unit includes a third sensor 38, in addition to the first sensor 36 and the second sensor 37.

That is, according to the second embodiment, in the state where the adjusting lever 18 is shifted between the first sensor 36 (first position) and the second sensor 37 (second position), the third sensor 38 detects the displacement amount from the reference position (for example, the first position or the second position) to control the driving of the delivery motor 16A and the winding motor 17A. A potential meter may be used as the third sensor 38 in this embodiment. The potential meter (third sensor 38) is adapted to be directly connected to the pivot shaft of the adjusting lever 18.

In addition, the potential meter is respectively connected to the delivery motor 16A and the winding motor 17A to control the revolution thereof. In other words, the potential meter (third sensor 38) changes the output value of the adjusting lever 18, which is shifted in response to the variation in the tension of the absorbing member 12, in accordance with the displacement amount from the reference position, thereby changing the revolution of the delivery motor 16A and the winding motor 17A, respectively.

More specifically, if the adjusting lever 18 comes closer to the first sensor 36 side (first position side), the revolution of the winding motor 17A is gradually reduced. In the case where the revolution of the winding motor 17A is constant, when the adjusting lever 18 turns the first sensor 36 on (when coming closer to the first position), the winding motor 17A is abruptly stopped to generate a reaction force. Thus, it is possible to suppress the reaction force from being transmitted to the absorbing member 12. In addition, if the adjusting lever 18 comes closer to the second sensor 37 side (second position side), the revolution of the delivery motor 16A is gradually reduced. In the case where the revolution of the delivery motor 16A is constant, when the adjusting lever 18 turns the second sensor 37 on (when coming closer to the second position), the deliver motor 16A is abruptly stopped to generate a reaction force. Thus, it is possible to suppress the reaction force from being transmitted to the absorbing member 12.

With the printer according to this embodiment, ON/OFF of the driving or stopping with respect to the delivery motor 16A or the winding motor 17A is controlled by the first sensor 36 and the second sensor 37, and the revolution of the delivery motor 16A (delivery reel 16) or the winding motor 17A (winding reel 17) is controlled by the third sensor in response to the displacement amount of the adjusting lever 18 (that is, the tension of the absorbing member 12), so that the tension of the absorbing member 12 can be more smoothly varied. Accordingly, it is possible to reliably prevent the vibration from being generated in the absorbing member 12.

Although FIG. 1 shows only a set of the head module 2, the maintenance device 10 and the flushing unit 12, actually, a set of the head module 2, the maintenance device 10 and the flushing unit 12 is already provided in the transport direction of the printing sheet. Two sets thereof have the same configuration mechanically, but they are provided out of alignment from the horizontal direction (arrangement direction of the heads 21A to 21E) perpendicular to the transport direction of the printing sheet. More specifically, when seen from the transport direction of the printing sheet, the heads 21A to 21E included in the second set of the head module 2 are interposed between the heads 21A to 21E included in the first set of the head module 2.

If two sets of the head modules 2, the maintenance device 10, and the flushing unit 12 are provided out of alignment from the horizontal direction perpendicular to the transport direction of the printing sheet, the heads 21A to 21E are wholly disposed in a zigzag form, so that the ink can be ejected onto the whole region of the effective printing width.

In two sets of the heads 21A to 21E in which two sets of the head modules 2 are disposed in the zigzag form, the pitch of each nozzle 24 constituting each nozzle row L is constantly formed between the adjacent heads which are out of alignment from the horizontal direction perpendicular to the transport direction of the printing sheet. In other words, the adjacent head which are out of alignment from the horizontal direction are placed in such a manner that the pitch of the nozzles 24 positioned at the inner end portions of the heads is equal to the pitch of the adjacent nozzles 24 and 24 in the same head. The adjacent head which are out of alignment from the horizontal direction may be placed in such a manner that one or a plurality of nozzles 24 and 24 positioned at the inner end portions of the heads are arranged in one row or a plurality of rows between the heads along the transport direction of the printing sheet. In such a case of arranging the nozzles, it is desirable that the fluid is not ejected from the nozzles 24 of one head among the nozzles 24 and 24 which are arranged in one low or a plurality of rows between the heads. With such a configuration, the pitch of each used nozzle 24 is constant.

In the case where the heads 21A to 21E are arranged adjacent to each other in the direction perpendicular to the transport direction of the printing sheet, it is desirable that the head module 2, the maintenance device 10, and the flushing unit 12 may form only one set. In this instance, since a sufficient gap is not formed between the heads 21A to 21E, it is difficult to provide the cap portions 61A to 61E included in the maintenance device 10 for every heads 21A to 21E. For this reason, it is desirable to use a single cap portion capable of enclosing the nozzle 24 of all heads 21A to 21E.

While the preferred embodiments of the invention are described as above with reference to the accompanying drawings, it is needless to say that the invention is not limited to the preferred embodiments. It is apparent that various modifications and corrections can be made within the scope of the invention spirit.

For example, the mechanism for moving the moving stages 55A and 55B is not limited to the configuration having the ball screw 57, and, for example, a configuration employing a rack and pinion or the like can be employed.

In the above-described embodiments, the configuration is described in which the absorbing member 12 extends in parallel to the nozzle rows. However, the invention is not limited thereto, and the extension direction of the absorbing member 12 may not be perfectly parallel to the extension direction of the nozzle rows. That is, in the invention, the expression "the absorbing members extend along the extension direction of the nozzle rows" is not limited only to the case where the extension direction of the absorbing members is perfectly parallel to the extension direction of the nozzle rows, but means the case where it is within such a range that the absorbing member 12 receives the ink droplets (fluid) when flushing. In addition, at the time of retraction, the nozzle rows may be inclined. For this reason, the moving amounts of the moving mechanism section 53A and moving mechanism section 53B may be different.

Further, in the above-described embodiments, a configuration is described in which the invention is applied to the line head type printer. However, the invention is not limited thereto, but may be applied to a serial type printer.

In addition, in the above-described embodiments, a configuration is described in which the absorbing member 12 always moves between the head unit 2 and the printing sheet (medium). However, the invention is not limited thereto, but may adopt a configuration in which the absorbing member 12 moves to a region (for example, a region on the side portions of the head unit 2) deviated from the positions right below the head unit 2 upon retracting the absorbing member 12.

Further, in the above-described embodiments, the fluid ejecting apparatus of the invention is applied to the ink jet printer, but it may be applied to a fluid ejecting apparatus for ejecting or discharging a fluid other than ink. That is, it may be applied to various fluid ejecting apparatuses including a fluid ejecting head for ejecting a minute number of liquid droplets. In this case, the expression "liquid droplets" means the fluid ejected from the fluid ejecting apparatus, and includes a liquid having a granular shape, a tear shape, or a thread shape as a trailing shape. Further, here, the fluid may be a material which can be ejected from the liquid ejecting apparatus.

For example, a liquid-state material may be used, and includes a liquid-state material such as sol or gel water having a high or low viscosity, a fluid-state material such as an inorganic solvent, an organic solvent, a liquid, a liquid-state resin, or liquid-state metal (metallic melt), and a material in which particles of a functional material having a solid material such as a pigment or a metal particle is dissolved, dispersed, or mixed with a solvent in addition to a fluid, as one state of a substance. In addition, ink described in the embodiments may be exemplified as a typical example of the fluid. Here, the ink indicates general water-based ink, oil-based ink, gel ink, or hot-melt ink which contains various fluid compositions.

As a detailed example of the fluid ejecting apparatus, for example, a liquid crystal display, an EL (electro-luminance) display, a plane-emission display, a fluid ejecting apparatus for ejecting a fluid containing dispersed or melted materials such as an electrode material or a color material used to manufacture a color filter, a fluid ejecting apparatus for ejecting a biological organic material used to manufacture a biochip, a fluid ejecting apparatus for ejecting a fluid as a sample used as a precision pipette, a printing apparatus, or a micro dispenser may be used.

In addition, a fluid ejecting apparatus for ejecting lubricant from a pinpoint to a precision machine such as a watch or a camera, a fluid ejecting apparatus for ejecting a transparent resin liquid such as a UV-curing resin onto a substrate in order to form a minute hemispherical lens (optical lens) used for an optical transmission element or the like, or a fluid ejecting apparatus for ejecting an etching liquid such as an acid liquid or an alkali liquid in order to perform etching on a substrate or the like may be adopted.

What is claimed is:

1. A fluid ejecting apparatus including a fluid ejecting head having nozzle rows formed by a plurality of nozzles, in which a fluid is ejected from the nozzle rows, the fluid ejecting apparatus comprising:

an absorbing member which extends along the nozzle rows, is installed so as to move from one side of the nozzle rows to the other side, and absorbs the fluid ejected from the nozzles;

a moving mechanism which moves the absorbing member in a direction intersecting the nozzle rows; and a running mechanism which runs the absorbing member from the one side of the nozzle rows to the other side, wherein the moving mechanism includes a pair of moving mechanism sections which are respectively placed at one side and the other side of the nozzle rows to move the absorbing member from a reference position of one side to a predetermined position of the other side in a direction perpendicular to the nozzle rows, and to move the absorbing member from the predetermined position to the reference position, wherein the moving mechanism section includes a moving member provided so as to reciprocate along the direction intersecting the nozzle rows, a positioning member provided on the moving member so as to move along the direction intersecting the nozzle rows, having a stop position at the predetermined position in the direction perpendicular to the nozzle rows, and having the absorbing member in a movable manner, and a first biasing member for biasing the positioning member from the reference position side to the predetermined position side in the direction perpendicular to the nozzle rows, wherein the pair of moving mechanism sections holds the absorbing member between the respective positioning members, and being adapted to extend the absorbing member along the nozzle row, wherein the positioning member is adapted to be biased in a direction opposite to the biasing direction of the first biasing member if a tension of the held absorbing member becomes strong, wherein a tension applying mechanism is provided which applies tension to the absorbing member held between the positioning members, and decreases the tension applied to the absorbing member if the positioning member moves to the reference position side in the direction perpendicular to the nozzle rows or increases the tension applied to the absorbing member if the positioning member moves to the predetermined position side.

2. The fluid ejecting apparatus according to claim 1, wherein the running mechanism includes a delivery rotation body which delivers the absorbing member by unwinding the absorbing member from a state where the absorbing member is wound, a delivery driving portion for rotating the delivery rotation body, a winding rotation body which winds the absorbing member delivered from the delivery rotation body, and a winding driving portion for rotating the winding rotation body.

3. The fluid ejecting apparatus according to claim 1, wherein the tension applying mechanism includes a tension adjusting member which applies a predetermined tension to the absorbing member held between the positioning members, and is displaced in accordance with the tension of the absorbing member to change an intensity of the tension applied to the absorbing member.

4. The fluid ejecting apparatus according to claim 3, wherein the tension adjusting member is provided in such a way that a holding position, in which the absorbing member is held, is displaceable in the direction intersecting the nozzle rows, and that the holding position is biased in the direction opposite to the biasing direction of the first biasing member by a second biasing member.

5. The fluid ejecting apparatus according to claim 3, wherein the running mechanism includes a delivery rotation body which delivers the absorbing member by unwinding the absorbing member from a state where the absorbing member is wound, a delivery driving portion for rotating the delivery rotation body, a winding rotation body which winds the absorbing member delivered from the delivery rotation body, and a winding driving portion for rotating the winding rotation body, wherein the tension adjusting member is provided at the delivery rotation body side from the nozzle row, wherein an inspection rotation body that makes the absorbing member to revolve and rotate according to the running of the absorbing member is provided in a running path of the absorbing member which runs between the delivery rotation body and the tension adjusting member, and wherein the inspection rotation body is provided with a detection mechanism for detecting a running length of the absorbing member which rotates the inspection rotation body by detecting the revolution of the inspection rotation body.

6. The fluid ejecting apparatus according to claim 5, wherein the inspection rotation body is provided with an identifier along a circumferential direction, and the detection mechanism detects the identifier to detect the revolution of the inspection rotation body.

* * * * *